US010304647B2

(12) United States Patent
Kitagawa

(10) Patent No.: US 10,304,647 B2
(45) Date of Patent: May 28, 2019

(54) RELAY

(71) Applicant: OMRON CORPORATION, Kyoto (JP)

(72) Inventor: Tatsuro Kitagawa, Koshi (JP)

(73) Assignee: OMRON CORPORATION, Kyoto-Shi, Kyoto (JP)

( * ) Notice: Subject to any disclaimer, the term of this patent is extended or adjusted under 35 U.S.C. 154(b) by 72 days.

(21) Appl. No.: 15/507,831

(22) PCT Filed: Aug. 5, 2015

(86) PCT No.: PCT/JP2015/072188
§ 371 (c)(1),
(2) Date: Mar. 1, 2017

(87) PCT Pub. No.: WO2016/075970
PCT Pub. Date: May 19, 2016

(65) Prior Publication Data

US 2017/0309430 A1 Oct. 26, 2017

Related U.S. Application Data

(63) Continuation of application No. PCT/JP2015/072188, filed on Aug. 5, 2015.

(30) Foreign Application Priority Data

Nov. 10, 2014 (JP) ..... 2014-228237
Mar. 11, 2015 (JP) ..... 2015-048612

(51) Int. Cl.
*H01H 51/22* (2006.01)
*H01H 50/56* (2006.01)
(Continued)

(52) U.S. Cl.
CPC ..... *H01H 51/2263* (2013.01); *H01H 1/5805* (2013.01); *H01H 50/54* (2013.01); *H01H 50/56* (2013.01); *H01H 51/2227* (2013.01)

(58) Field of Classification Search
CPC ..... H01H 51/2263; H01H 50/54
(Continued)

(56) References Cited

U.S. PATENT DOCUMENTS 3,688,230 A * 8/1972 Tichy ..... H01H 50/42 335/201
3,689,858 A * 9/1972 Helmut Rosch ..... H01H 51/088 335/188
(Continued)

FOREIGN PATENT DOCUMENTS

CN 102237207 A 11/2011
CN 103187206 A 7/2013
(Continued)

OTHER PUBLICATIONS

1st Office Action of the corresponding Chinese patent application No. 201580047101.7, dated Apr. 16, 2018.
(Continued)

*Primary Examiner* — Shawki S Ismail
*Assistant Examiner* — Lisa N Homza
(74) *Attorney, Agent, or Firm* — United IP Counselors, LLC

(57) ABSTRACT

A relay includes a movable block, a base substrate, and a coil block. The movable block is provided rotatably around a rotational axis of the movable block. The movable block includes a plurality of sliders. The base substrate is disposed opposite the movable block in the rotational axis direction of the movable block, and contacts the sliders. The base substrate includes a plurality of contactors that come into contact with the sliders. The coil block includes a coil that
(Continued)

generates electromagnetic force by electric conduction to rotate the movable block with respect to the base substrate. As the movable block rotates, continuity is switched between the sliders and the contactors.

23 Claims, 32 Drawing Sheets

(51) Int. Cl.
*H01H 50/54* (2006.01)
*H01H 1/58* (2006.01)

(58) Field of Classification Search
USPC ..... 335/80
See application file for complete search history.

(56) References Cited

U.S. PATENT DOCUMENTS 3,713,055 A * 1/1973 Halbeck ..... H01H 50/541 200/283
3,745,496 A * 7/1973 Tichy ..... H01H 50/42 335/230
3,987,383 A * 10/1976 Antonitsch ..... H01H 50/043 335/78
4,151,496 A * 4/1979 Imai ..... H01H 63/20 335/123
4,225,835 A * 9/1980 Vrsnak ..... H01H 51/2281 335/78
4,250,477 A * 2/1981 Graninger ..... H01H 50/545 335/169
4,262,270 A * 4/1981 Takeda ..... H01H 51/086 335/123
4,325,041 A * 4/1982 Murai ..... H01H 71/04 335/16
4,535,310 A * 8/1985 Schubring ..... H01H 50/88 116/307
4,553,117 A * 11/1985 Schubring ..... H01H 50/88 335/59
4,713,638 A * 12/1987 Kamo ..... H01H 51/2227 335/234
4,727,344 A * 2/1988 Koga ..... H01F 7/1646 335/229
4,743,877 A * 5/1988 Oberndorfer ..... H01H 50/58 335/128
5,055,811 A * 10/1991 Kakizoe ..... H01H 50/88 335/131
5,119,055 A * 6/1992 Kidd ..... H01H 51/06 335/128
5,502,426 A * 3/1996 Blanchard ..... H01H 71/56 335/132
5,515,019 A * 5/1996 Schedele ..... H01H 50/026 335/130
5,534,832 A * 7/1996 Duchemin ..... H01H 89/08 218/22
8,222,981 B1 * 7/2012 Zarbock ..... H01H 51/2272 335/107
8,564,386 B2 * 10/2013 Moeller ..... H01H 51/2272 335/132
8,610,521 B2 * 12/2013 Degner ..... H01H 50/18 335/102
9,013,254 B2 * 4/2015 Molyneux ..... H05K 5/06 335/205
2005/0068130 A1 * 3/2005 Bergh ..... H01H 50/326 335/128
2005/0219017 A1 * 10/2005 Shirakawa ..... G02B 6/3564 335/78
2007/0126538 A1 * 6/2007 Liu ..... H01H 50/32 335/172
2007/0229203 A1 * 10/2007 Mikl ..... H01H 50/36 335/78
2008/0272866 A1 * 11/2008 Ohkubo ..... H01H 71/123 335/17
2012/0081199 A1 * 4/2012 Hao ..... H01H 51/08 335/158
2013/0278362 A1 * 10/2013 Iwamoto ..... H01H 51/22 335/78
2014/0184366 A1 * 7/2014 Ito ..... H01H 50/54 335/189
2015/0311020 A1 * 10/2015 Elberbaum ..... H01H 51/27 335/168

FOREIGN PATENT DOCUMENTS

JP H08250003 A 9/1996
JP 2005071815 A 3/2005

OTHER PUBLICATIONS

International Search Report dated Oct. 13, 2015 for corresponding foreign Application No. PCT/JP2015/072188, 1 pp.

* cited by examiner

RELAY

CROSS-REFERENCE TO RELATED APPLICATIONS

This application is the U.S. National Phase of PCT International Application No. PCT/JP2015/072188, filed on Aug. 5, 2015. That application claims priority to Japanese Patent Application No. 2014-228237, filed Nov. 10, 2014 and to Japanese Patent Application No. 2015-048612, filed Mar. 11, 2015. The contents of the three above applications are herein incorporated by reference in their entirety.

TECHNICAL FIELD

The present disclosure relates to a relay.

BACKGROUND

A relay includes a coil and an armature. When power is switched on to the coil, the electromagnetic force thus produced operates the armature. This switches the movable and fixed contacts provided to the armature on and off.

For instance, with the relay in Japanese Laid-Open Patent Application H08-250003, an armature is pivotably supported, and movable contact segments are attached to both ends of the armature. The movable contact segments move when the armature pivots under the electromagnetic force of the coil. This switches the contacts on and off.

With the relay in Japanese Laid-Open Patent Application 2005-71815, an armature is linked to movable contact segments via linking members. When the armature rotates under the electromagnetic force of the coil, the rotational motion of the armature is converted through the linking member into linear motion, which is transmitted to the movable contact segments. This switches the contacts on and off.

BRIEF SUMMARY

With the relays discussed above, the number of movable contact segments has to be increased in order to increase the number of poles of the contacts. If the number of movable contact segments is increased, the structure used to support the movable contact segments becomes larger. Therefore, a problem is that the relay becomes bulkier. Also, it is conceivable that the number of poles could be increased by combining a plurality of relays into a relay module. For instance, with a four-pole relay, as shown in FIG. 32, a relay module 100 with 32 poles overall can be configured by disposing eight relays 200 are disposed on a substrate 300. Here again, however, we encounter the problem of increased size for the relay module as a whole. Also, since the relays have to be soldered onto the substrate, another problem is that the number of manufacturing steps increases.

Furthermore, the contact pressure between movable contact segments and fixed contacts is obtained by pressing the movable contact segments against the fixed contacts by means of the electromagnetic force of a coil. In this case, the contact pressure tends to be affected by variance in the dimensions of the constituent parts. For example, there is the risk that variance will occur in the contact pressure as a result of variance in the distance between the movable contact segments and the fixed contacts, the length of the linking members, etc. Therefore, it is no easy task to improve contact reliability in contacts.

It is an object of the present disclosure to provide a relay with which the number of contact poles can be increased while minimizing an increase in size, and the contact reliability of the contacts is high.

The relay pertaining to one aspect of the present disclosure includes a movable block, a base substrate, a coil block, and a plurality of contactors. The movable block is provided rotatably around a rotational axis of the movable block. The movable block includes a plurality of sliders. The base substrate is disposed opposite the movable block in the rotational axis direction of the movable block, and is in contact with the sliders. The base substrate includes a plurality of contactors configured to come into contact with the sliders. The coil block includes a coil. The coil is configured to generate electromagnetic force by electric conduction to rotate the movable block with respect to the base substrate. As the movable block rotates, continuity is switched between the sliders and the contactors.

With the relay pertaining to this aspect, when the movable block rotates under the electromagnetic force of the coil block, the sliders slide over the base substrate. Consequently, the sliders move to a position of coming into contact with the contactors, resulting in continuity between the sliders and the contactors. Also, when the sliders slide over the base substrate and move to a position where there is no contactor, continuity is broken between the sliders and the contactors. Thus, when the sliders move while still in contact with the base substrate, the continuity state between the sliders and the contactors is switched. Specifically, the continuity state can be switched while maintaining a constant contact pressure at the contactors, so contact reliability between the sliders and the contactors can be easily increased. Also, with the relay pertaining to this aspect, numerous sliders and contactors can be easily disposed in a small space. Accordingly, the number of sliders in the movable block and the number of contactors on the base substrate can be increased, which means that more pairs of slider and contactor will participate in the switching of the continuity state, while keeping an increase in size to a minimum.

Preferably, the sliders are disposed spaced apart in the radial direction and in the peripheral direction of the rotation of the movable block. In this case, numerous sliders can be disposed in a small space.

Preferably, the contactors are disposed spaced apart in the radial direction and in the peripheral direction of the rotation of the movable block on the base substrate. In this case, numerous contactors can be disposed in a small space.

Preferably, the sliders include a first slider. Preferably, the contactors include a first contactor. The first slider is provided movably between a contact position where it is in contact with the first contactor, and a non-contact position where it is not in contact with the first contactor. When the coil block rotates the movable block in a predetermined direction, the first slider moves from the non-contact position to the contact position. When the coil block rotates the movable block in the opposite direction from said predetermined direction, the first slider moves from the contact position to the non-contact position. In this case, the continuity state between the first slider and the first contactor can be switched by switching the rotational direction of the movable block.

Preferably, the sliders include a second slider. Preferably, the contactors include a second contactor. The second slider is provided movably between a contact position where it is in contact with the second contactor, and a non-contact position where it is not in contact with the second contactor.

When the coil block rotates the movable block in a predetermined direction, the first slider moves from the non-contact position to the contact position, and the second slider moves from the contact position to the non-contact position. When the coil block rotates the movable block in the opposite direction from said predetermined direction, the first slider moves from the contact position to the non-contact position, and the second slider moves from the non-contact position to the contact position. In this case, the first slider and the second slider can constitute a continuity state between the sliders and contactors that function the same as an NO contact and an NC contact. Also, it is possible to switch alternately between a continuity state between the sliders and contactors that function the same as an NO contact and a continuity state between the sliders and contactors that function the same as an NC contact, by switching the rotational direction of the movable block. The term "NO contact" refers to a contact configuration in which the contact is normally open, but is closed during operation (during movable block rotation). "NC contact" refers to a contact configuration in which the contact is normally closed, but is open during operation (during movable block rotation).

Preferably, the movable block further includes a third slider. Preferably, the base substrate further includes a third contactor. The third slider is configured to be in constant contact with the third contactor while the first slider moves between the contact position and the non-contact position. In this case, a continuity state between the sliders and contactors that function the same as an NO contact, an NC contact, and a CO contact can be constituted by suitably combining the third slider with the first slider or the second slider. The term "CO contact" here refers to a contact configuration that is a combination of an NO contact and an NC contact.

Preferably, the third slider is disposed closer to the rotational axis than the first slider. In this case, the movement distance of the third slider by the rotation of the movable block is less than the movement distance of the first slider. Therefore, the length over which the third contactor comes into contact with the third slider can be shortened. Also, since the movement distance of the first slider can be increased, the insulation distance between the first slider and the first contactor can be increased.

Preferably, the movable block further includes a rotary substrate. The rotary substrate is disposed opposite the base substrate in the rotational axis direction. The sliders are attached to the rotary substrate. The rotary substrate electrically connects the sliders. In this case, the contact configuration and the number of pairs of slider and contactor that participate in the switching of the continuity state can be easily changed by changing the layout of the sliders and the wiring pattern of the rotary substrate.

Preferably, the sliders have a shape that curves toward the rotational direction of the movable block. In this case, the sliding resistance of the sliders during rotation can be reduced. Also, since good springiness can be imparted to the sliders, contact reliability can be further improved.

Preferably, the plurality of sliders includes sliders with a shape that curves toward the predetermined rotational direction, and sliders with a shape that curves in the opposite direction from said predetermined rotational direction. In this case, the difference in sliding resistance attributable to a difference in rotational direction can be reduced.

Preferably, the relay further includes a plurality of terminals that are connected to the base substrate. Preferably, each of the terminals is electrically connected to one of the contactors on the base substrate. In this case, the contact configuration and the number of pairs of slider and contactor that participate in the switching of the continuity state can be easily changed by changing the layout of the contactors and the wiring pattern of the base substrate.

Preferably, at least two of the contactors are connected to a common terminal by a pattern on the base substrate. In this case, the number of terminals can be reduced and the distance between terminals can be increased. Also, reducing the number of terminals allows the design of the pattern to which the relay is attached to be simplified.

Preferably, the coil block includes a first coil and a second coil that is separate from the first coil. In this case, the relay can be made more compact by dividing up the coil block into a first coil and a second coil.

Preferably, the magnetic circuit of the first coil and the magnetic circuit of the second coil are independent of each other. In this case, the magnetic flux of the first coil and the magnetic flux of the second coil interfere with each other less. Consequently, there is less magnetic loss, and a stronger electromagnetic force can be exerted on the movable block.

Preferably, the first coil and the second coil are disposed spaced apart. The movable block includes an armature disposed between the first coil and the second coil. In this case, the armature is attracted by the electromagnetic force between the first coil and second coil, allowing the movable block to be rotated.

Preferably, the armature includes a first contact part and a second contact part. When the movable block rotates in a predetermined direction, the first contact part comes into contact with the coil block, thereby restricting the amount of rotation of the movable block in the predetermined direction. When the movable block rotates in the opposite direction from said predetermined direction, the second contact part comes into contact with the coil block, thereby restricting the amount of rotation of the movable block in said opposite direction. In this case, the amount of movement of the sliders when the continuity state between the sliders and contactors is switched can be prescribed by bringing the first contact part or the second contact part into contact with the coil block.

Preferably, the coil block includes a first yoke and a second yoke. The first yoke protrudes toward the armature between the first coil and the second coil. The second yoke that protrudes toward the armature from the side opposite the first yoke between the first coil and the second coil. Preferably, the armature includes a first concave part and a second concave part. The distal end of the first yoke is disposed in the first concave part. The distal end of the second yoke is disposed in the second concave part. In this case, the amount of rotation of the movable block can be restricted by contact between the first concave part and the first yoke, and/or contact between the second concave part and the second yoke.

Preferably, the first coil and the second coil each have a first layer and a second layer whose wiring direction is different from that of the first layer. In this case, a double-coil latching relay can be obtained without changing any of the other parts.

Preferably, the movable block is sandwiched between the base substrate and the coil block. Preferably, the coil block is attached to the base substrate so as to press the movable block toward the base substrate. In this case, the coil block presses on the movable block, which maintains the contact pressure between the sliders and contactors. Consequently, the continuity state can be switched while the contact pressure of the contactors is kept constant, so contact reliability can be further improved.

Preferably, the movable block includes a plurality of protrusions that come into contact with the coil block. In this case, the coil block presses on the movable block via a plurality of protrusions. Therefore, the movable block can be pressed stably and with less bias. Also, rotation of the movable block causes friction in the coil block and the protrusions. Therefore, the portion that is worn down by friction between the movable block and the coil block can be limited to the protrusions.

Preferably, the protrusions are disposed symmetrically with respect to the rotational axis. In this case, the coil block can press on the movable block even more stably and with less bias.

Preferably, the movable block includes a plurality of concave parts. These concave parts are respectively disposed around the protrusions. In this case, any wear dust produced by friction between the protrusions and the coil block can be held in the concave parts. This minimizes the amount of wear dust that is scattered into the surrounding area.

The present disclosure provides a relay with which the number of contact poles can be increased while minimizing an increase in size, and which has high contact reliability of the contacts.

DETAILED DESCRIPTION OF EMBODIMENTS

Figure 1:
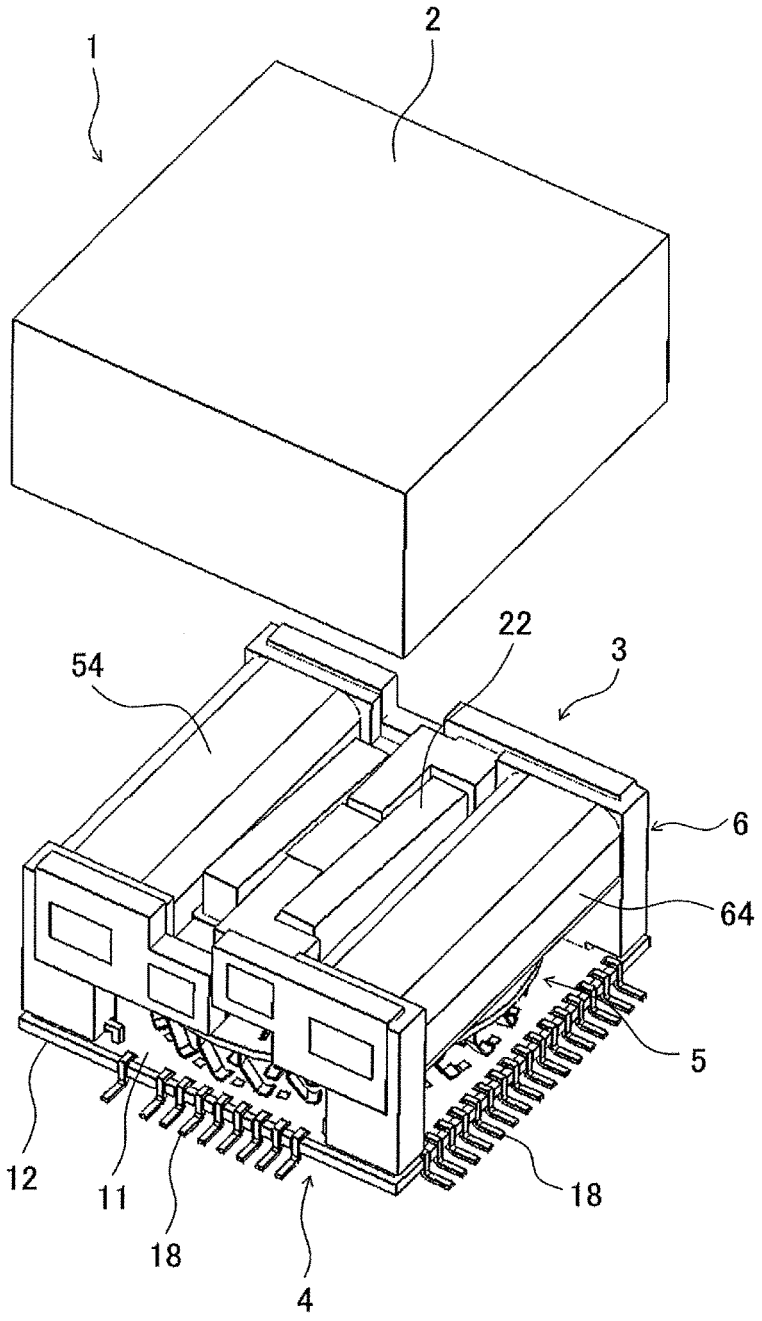
FIG. 1 is an exploded oblique view of a relay.

A relay 1 pertaining to an embodiment will now be described through reference to the drawings. FIG. 1 is an exploded oblique view of the relay 1. As shown in FIG. 1, the relay 1 includes a cover 2 and a main body 3. The cover 2 is attached to the main body 3 so as to cover the main body 3. The up and down directions in this embodiment refer to the up and down directions in FIG. 1, respectively. However, this labeling of the directions in this embodiment is only intended to help in the description, and not to limit the attachment direction of the relay 1 or the like.

Figure 2:
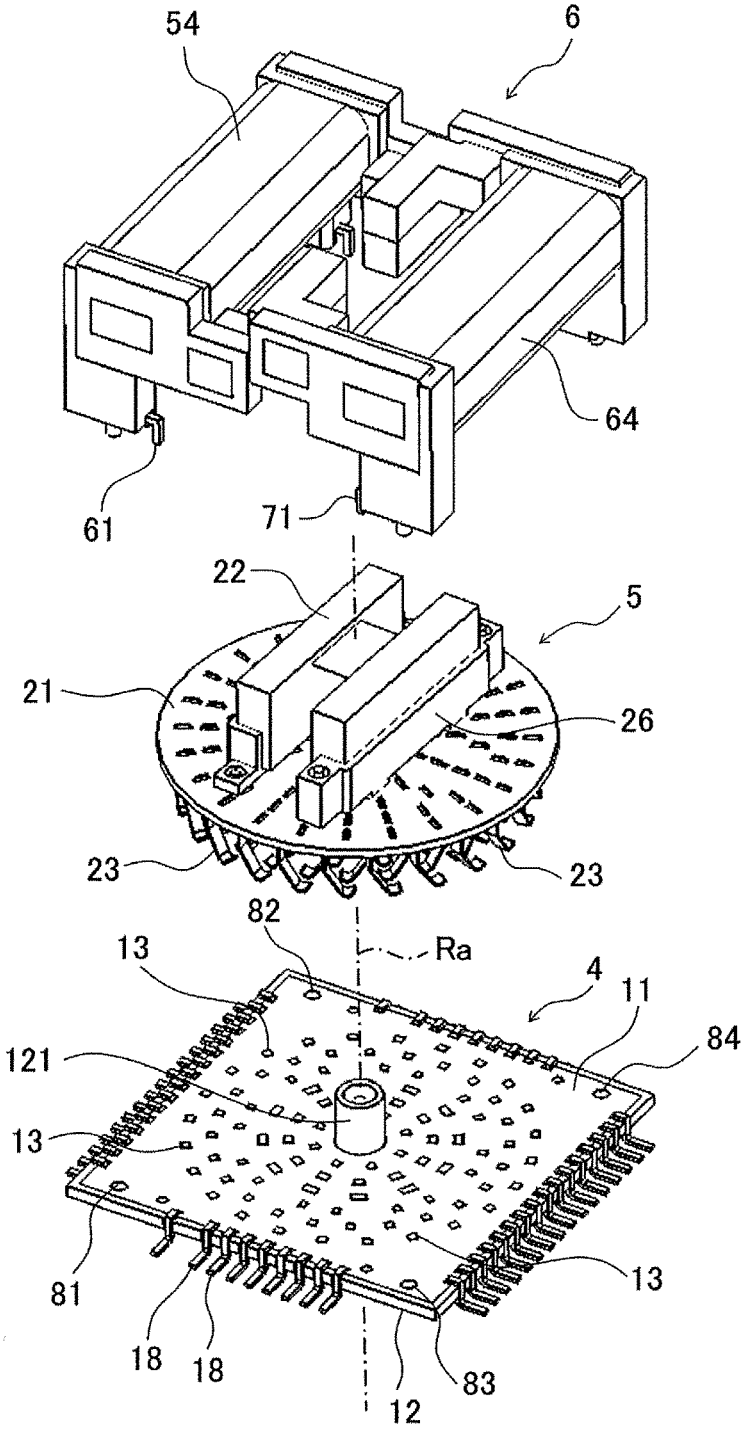
FIG. 2 is an exploded oblique view of the main body as seen obliquely from above.
Figure 3:
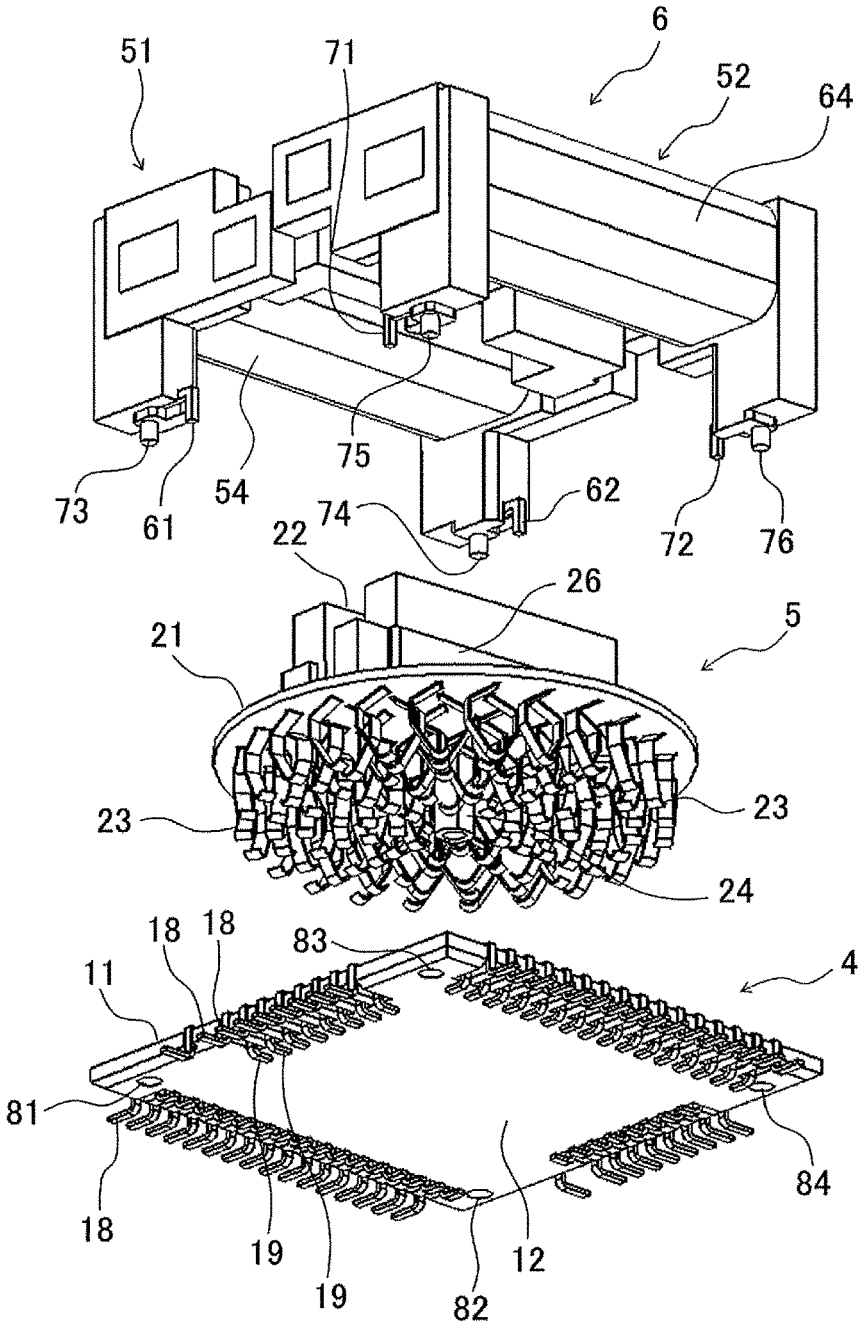
FIG. 3 is an exploded oblique view of the main body as seen obliquely from below.

FIG. 2 is an exploded oblique view of the main body 3 as seen obliquely from above. FIG. 3 is an exploded oblique view of the main body 3 as seen obliquely from below. As shown in FIGS. 2 and 3, the main body 3 includes a base block 4, a movable block 5, and a coil block 6.

Figure 4:
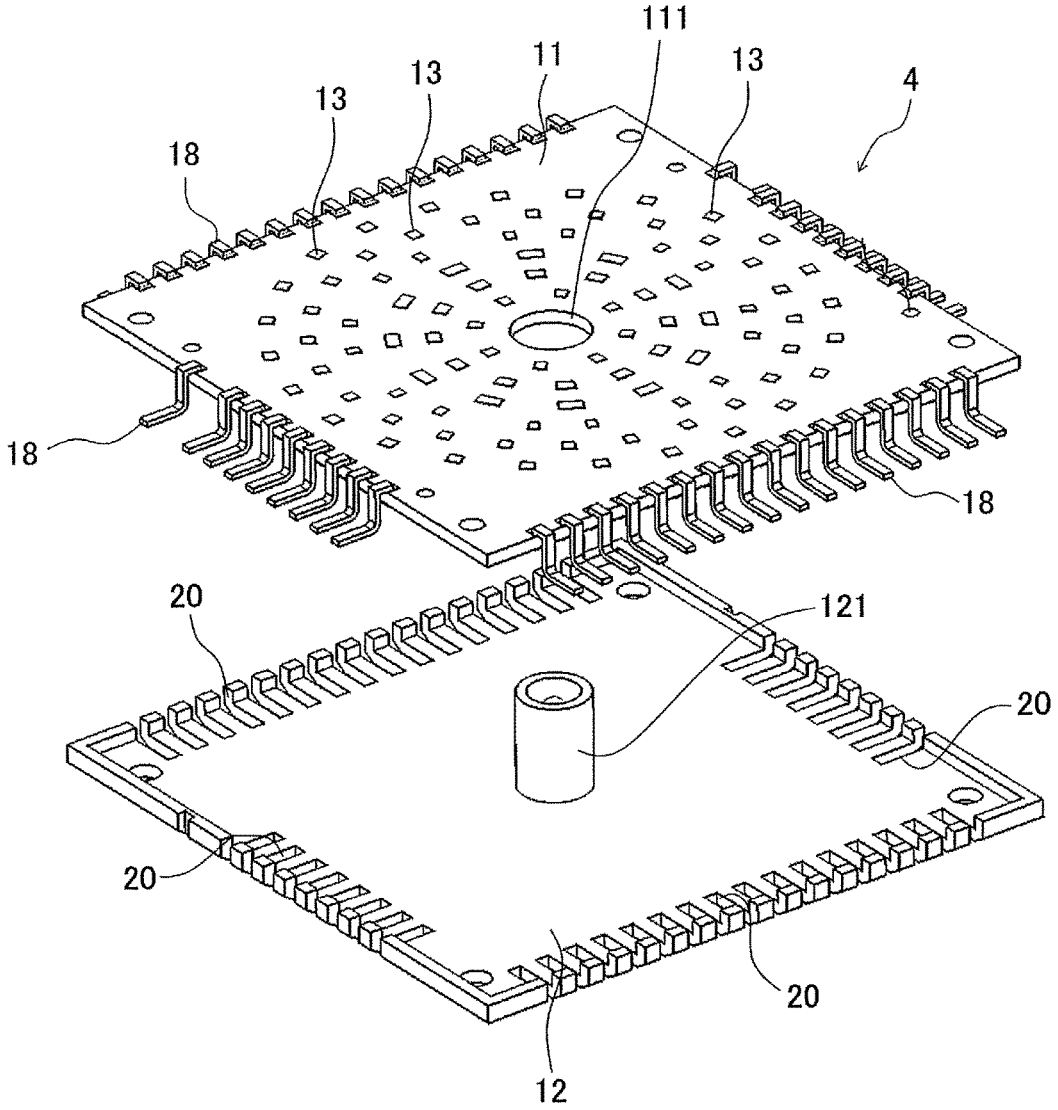
FIG. 4 is an exploded oblique view of a base block.

The base block 4 rotatably supports the movable block 5. FIG. 4 is an exploded oblique view of the base block 4. As shown in FIG. 4, the base block 4 includes a base substrate 11 and a base member 12.

Figure 5:
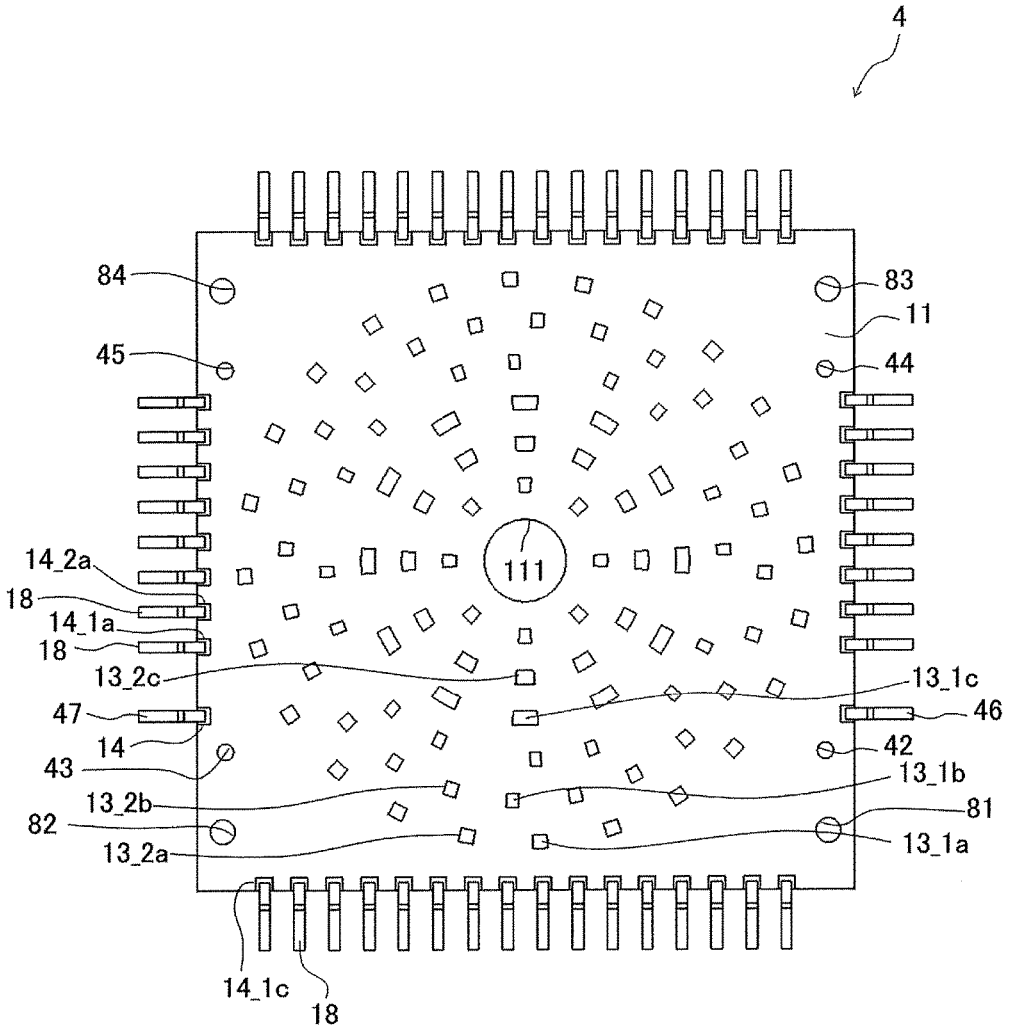
FIG. 5 is a top view of a base substrate.
Figure 6:
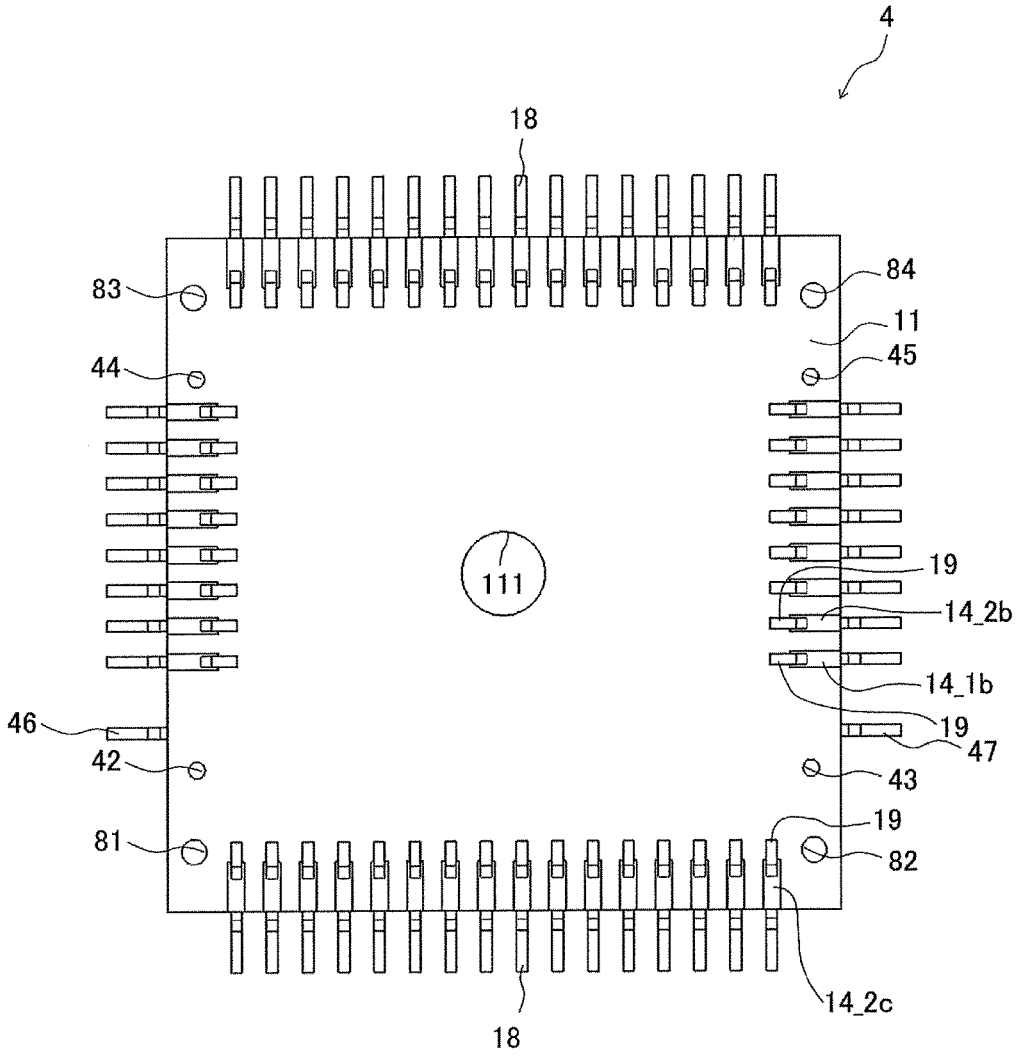
FIG. 6 is a bottom view of the base substrate.

FIG. 5 is a top view of the base substrate 11. FIG. 6 is a bottom view of the base substrate 11. The base substrate 11 is disposed opposite the movable block 5 in the direction of the rotational axis Ra of the movable block 5 (see FIG. 2). The base substrate 11 has a quadrilateral shape, such as a square shape or a rectangular shape. The base substrate 11 is disposed on the base member 12, and is attached to the base member 12. The base substrate 11 includes a through-hole 111. The through-hole 111 is disposed in the approximate center of the base substrate 11.

A support 121 is provided to the base member 12. The support 121 has a cylindrical shape. The support 121 protrudes from the base member 12. As shown in FIG. 2, the support 121 protrudes through the through-hole 111 of the base substrate 11. The support 121 rotatably supports the movable block 5.

The base substrate 11 includes a plurality of contactors 13. The contactors 13 are formed from an electroconductive material. In this embodiment, the base substrate 11 has 96 contactors 13. However, the number of contactors 13 is not limited to 96, and may be greater than or less than 96. In the drawings, only some of the contactors 13 are labeled, and the rest of the contactors 13 are not.

The contactors 13 are disposed around the through-hole 111. The contactors 13 are disposed along radial lines centered on the rotational axis Ra of the movable block 5 on the base substrate 11. The contactors 13 are disposed on the base substrate 11, spaced apart in the radial direction and the peripheral direction of the rotation of the movable block 5. The contactors 13 have a flat shape.

The base substrate 11 includes a plurality of terminal connectors 14. The terminal connectors 14 are provided to both the front and rear faces of the base substrate 11. The front of the base substrate 11 is the side on which the contactors 13 are provided. The rear of the base substrate 11 is the opposite side from the one on which the contactors 13 are provided. In the drawings, only some of the terminal connectors 14 are labeled, and the rest of the terminal connectors 14 are not.

The front face of the base substrate 11 is disposed perpendicular to the rotational axis Ra. The rear face of the base substrate 11 is also disposed perpendicular to the rotational axis Ra. The terminal connectors 14 are disposed around the edges of the base substrate 11. The terminal connectors 14 have a flat shape.

A plurality of terminals 18 and 19 are respectively attached to the terminal connectors 14. In this embodiment, the terminals 18 and 19 are terminals used for surface mounting, and have a curved distal end, but may instead be terminals used with a through-hole.

The terminals 18 attached to the terminal connectors 14 on the front of the base substrate 11 protrude laterally from the edges of the base substrate 11. As shown in FIG. 4, a plurality of slits 20 are provided to the edges of the base member 12. As shown in FIG. 3, the terminals 19 attached to the terminal connectors 14 on the rear face of the base substrate 11 protrude through the slits 20 from the base member 12. In FIG. 4, only some of the slits 20 are labeled, and the rest of the slits 20 are not.

As shown in FIGS. 5 and 6, the contactors 13 include a plurality of first contactors 13_1*a* and 13_2*a*, a plurality of second contactors 13_1*b* and 13_2*b*, and a plurality of third contactors 13_1*c* and 13_2*c*. The terminal connectors 14 include a plurality of first terminal connectors 14_1*a* and 14_2*a*, a plurality of second terminal connectors 14_1*b* and 14_2*b*, and a plurality of third terminal connectors 14_1*c* and 14_2*c*. What comes after the "_" (underscore) in the labels of the contactors 13, the terminal connectors 14, and the sliders 23 (discussed below) denotes the contact configuration. As will be discussed below, the first contactors constitute NO contacts. The second contactors constitute NC contacts. The third contactors constitute CO contacts.

In FIGS. 5 and 6, only some of the first contactors (13_1*a* and 13_2*a*), some of the second to contactors (13_1*b* and 13_2*b*), and some of the third contactors (13_1*c* and 13_2*c*) are labeled, and the rest of the first contactor, second contactors, and third contactors are not.

The first contactor 13_1*a*, the second contactor 13_1*b*, and the third contactor 13_1*c* are disposed spaced apart in the radial direction in the rotation of the movable block 5. The third contactor 13_1*c* is disposed closer to the rotational axis Ra than the first contactor 13_1*a* and the second contactor 13_1*b*.

The first contactor 13_2*a*, the third contactor 13_2*c*, and the second contactor 13_2*b* are disposed spaced apart in the radial direction in the rotation of the movable block 5. The third contactor 13_2*c* is disposed closer to the rotational axis Ra than the first contactor 13_2*a* and the second contactor 13_2*b*.

The base substrate 11 electrically connects the contactors 13 to the terminal connectors 14. For example, the first contactor 13_1*a* is connected to the first terminal connector 14_1*a*. The second contactor 13_1*b* is connected to the second terminal connector 14_1*b*. The third contactor 13_1*c* is connected to the third terminal connector 14_1*c*. The first contactor 13_2*a* is connected to the first terminal connector 14_2*a*. The second contactor 13_2*b* is connected to the second terminal connector 14_2*b*. The third contactor 13_2*c* is connected to the third terminal connector 14_2*c*. Although not described in detail, the other contactors 13 and the other terminal connectors 14 are similarly electrically connected to each other on the base substrate 11.

The base substrate 11 is what is known as a printed substrate. The contactors 13 and the to terminal connectors 14 are patterns formed on a printed substrate, and are formed from copper foil or another such conductor. The contactors 13 and the terminal connectors 14 are not covered by an insulator, being exposed instead.

As shown in FIGS. 1 and 2, the movable block 5 is disposed on the base block 4. The movable block 5 is sandwiched between the base substrate 11 and the coil block 6. The movable block 5 includes a rotary substrate 21, an armature 22, and a plurality of sliders 23.

Figure 7:
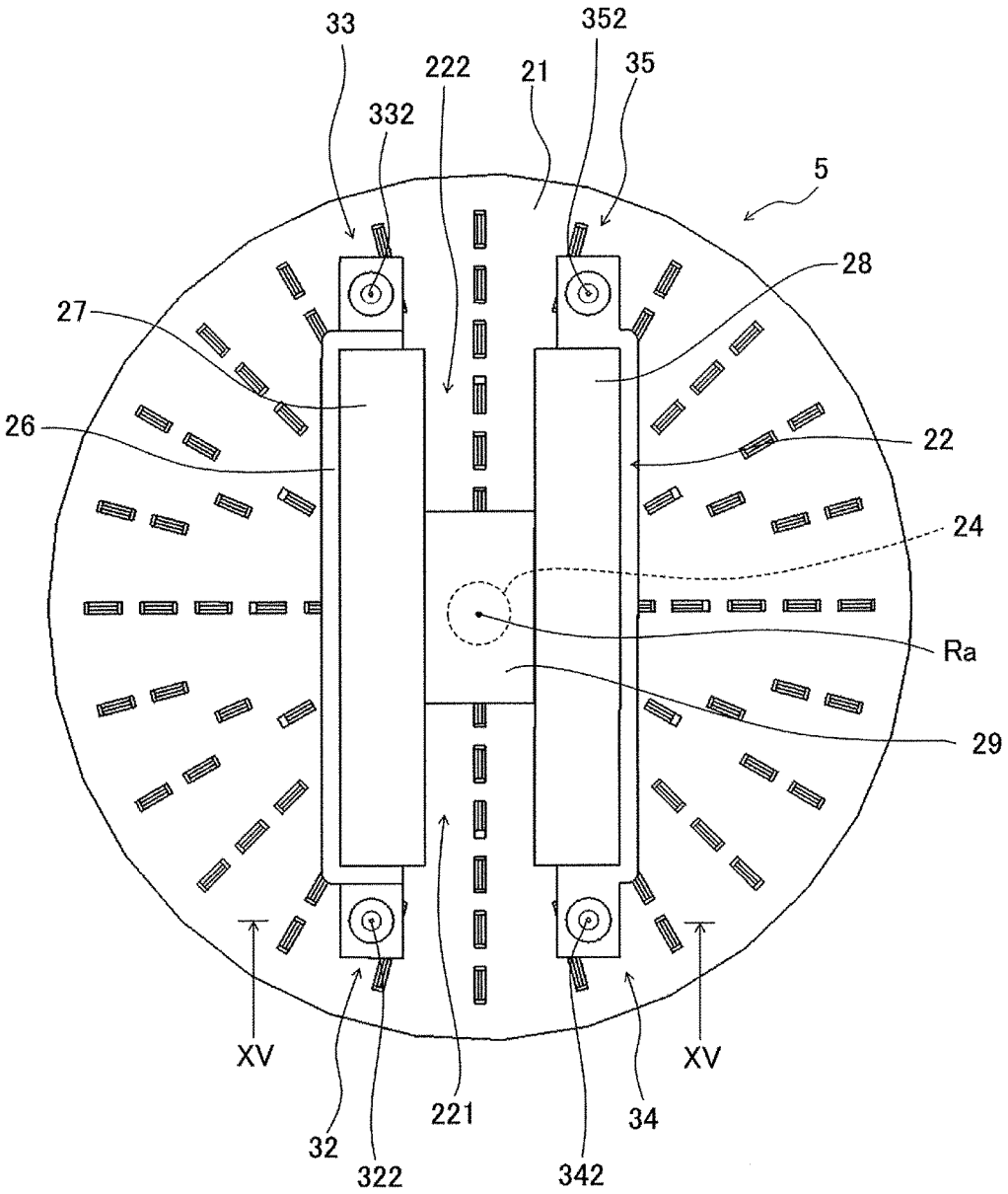
FIG. 7 is a top view of a movable block.

FIG. 7 is a top view of the movable block 5. As shown in FIG. 7, the rotary substrate 21 is in the form of a disk. The rotary substrate 21 is disposed opposite the base substrate 11 in the rotational axis Ra direction. As shown in FIGS. 3 and 7, the movable block 5 includes a rotary shaft 24. The above-mentioned rotational axis Ra is concentric with the rotary shaft 24. As shown in FIG. 3, the rotary shaft 24 protrudes from the rear face of the rotary substrate 21. The rear face of the rotary substrate 21 is opposite the front of the base substrate 11. The rotary shaft 24 is supported by the support 121 of the base block 4. The rotary shaft 24 is disposed inside the support 121. Therefore, the rotary shaft 24 is covered by the support 121. This helps prevent wear dust produced by the rotation of the rotary shaft 24 from scattering to the surrounding area.

The sliders 23 are attached to the rotary substrate 21. In this embodiment, the movable block 5 has 96 sliders 23. However, the number of sliders 23 is not limited to 96, and may be greater than or less than 96. The sliders 23 are formed from an electroconductive material. The sliders 23 are attached to the rear of the rotary substrate 21.

Figure 8:
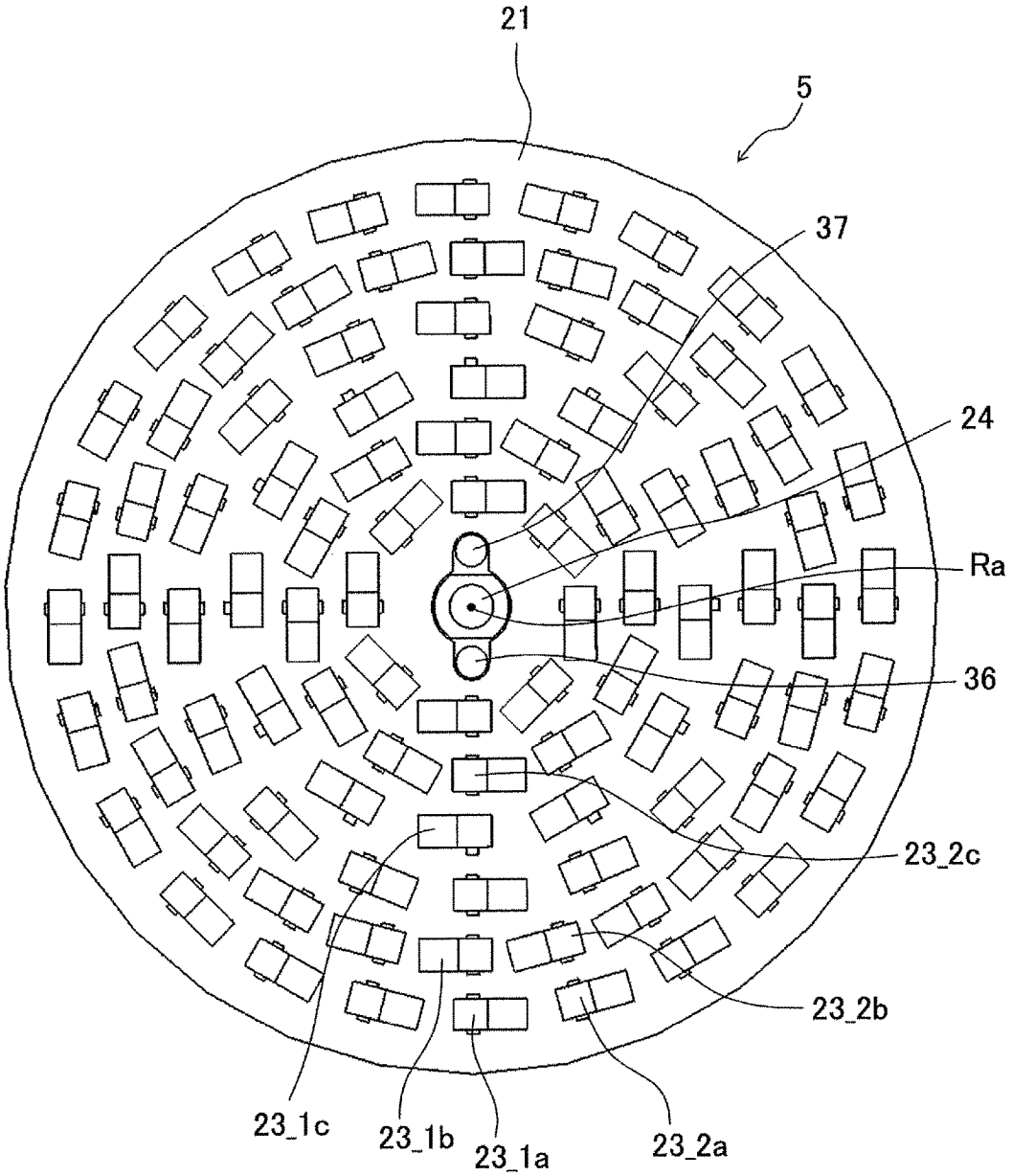
FIG. 8 is a bottom view of the movable block.

FIG. 8 is a bottom view of the movable block 5. As shown in FIG. 8, the sliders 23 are disposed spaced apart in the radial direction and in the peripheral direction of the rotation of the movable block 5. The sliders 23 are disposed along radial lines centered on the rotational axis Ra of the movable block 5.

Figure 9:
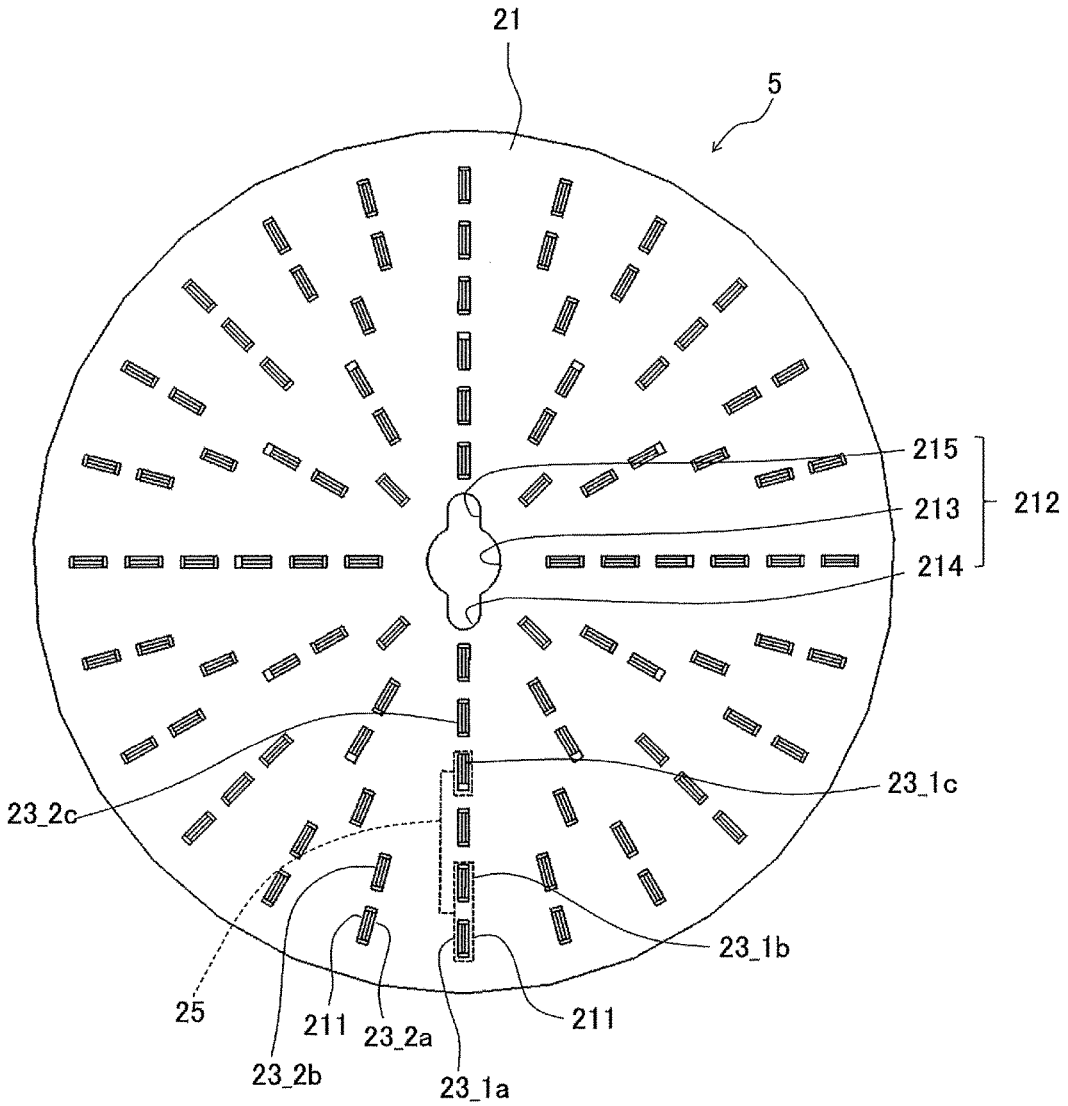
FIG. 9 is a top view of the movable block when the armature has been removed.

FIG. 9 is a top view of the movable block 5 when the armature 22 has been removed. As shown in FIG. 9, a plurality of through-holes 211 are provided to the rotary substrate 21. In FIG. 9, only some of the through-holes 211 are labeled, and the rest of the through-holes 211 are not. The through-holes 211 have a slender shape that extends in the radial direction of the rotary substrate 21. The sliders 23 are attached in the through-holes 211.

The rotary substrate 21 electrically connects the sliders 23. The rotary substrate 21 is what is known as a printed substrate. The through-holes 211 are electrically connected by a wiring pattern 25 formed on the printed substrate. Therefore, the sliders 23 are electrically connected to each other by attaching the sliders 23 to the through-holes 211.

More precisely, the sliders 23 include a plurality of first sliders 23_1*a* and 23_2*a*, a plurality of second sliders 23_1*b* and 23_2*b*, and a plurality of third sliders 23_1*c* and 23_2*c*. The first slider 23_1*a*, the second slider 23_1*b*, and the third slider 23_1*c* are disposed spaced apart in the radial direction in the rotation of the movable block 5. The third slider 23_1*c* is disposed closer to the rotational axis Ra than the first slider 23_1*a* and the second slider 23_1*b*.

The first slider 23_2*a*, the third slider 23_2*c*, and the second slider 23_2*b* are disposed spaced apart in the radial direction in the rotation of the movable block 5. The third slider 23_2*c* is disposed closer to the rotational axis Ra than the first slider 23_2*a* and the second slider 23_2*b*.

The first slider 23_1*a*, the second slider 23_1*b*, and the third slider 23_1*c* are electrically connected to each other. Although not depicted in the drawings, the first slider 23_2*a*, the second slider 23_2*b*, and the third slider 23_2*c* are also electrically connected to each other.

In FIG. 9, only some of the first sliders (23_1*a* and 23_2*a*), some of the second sliders (23_1*b* and 23_2*b*), and some of the third sliders (23_1*c* and 23_2*c*) are labeled, and the rest of the first sliders, second sliders, and third sliders are not. Although not described in detail, the rest of the first sliders, second sliders, and third sliders are similarly connected together by wiring.

Figure 10:
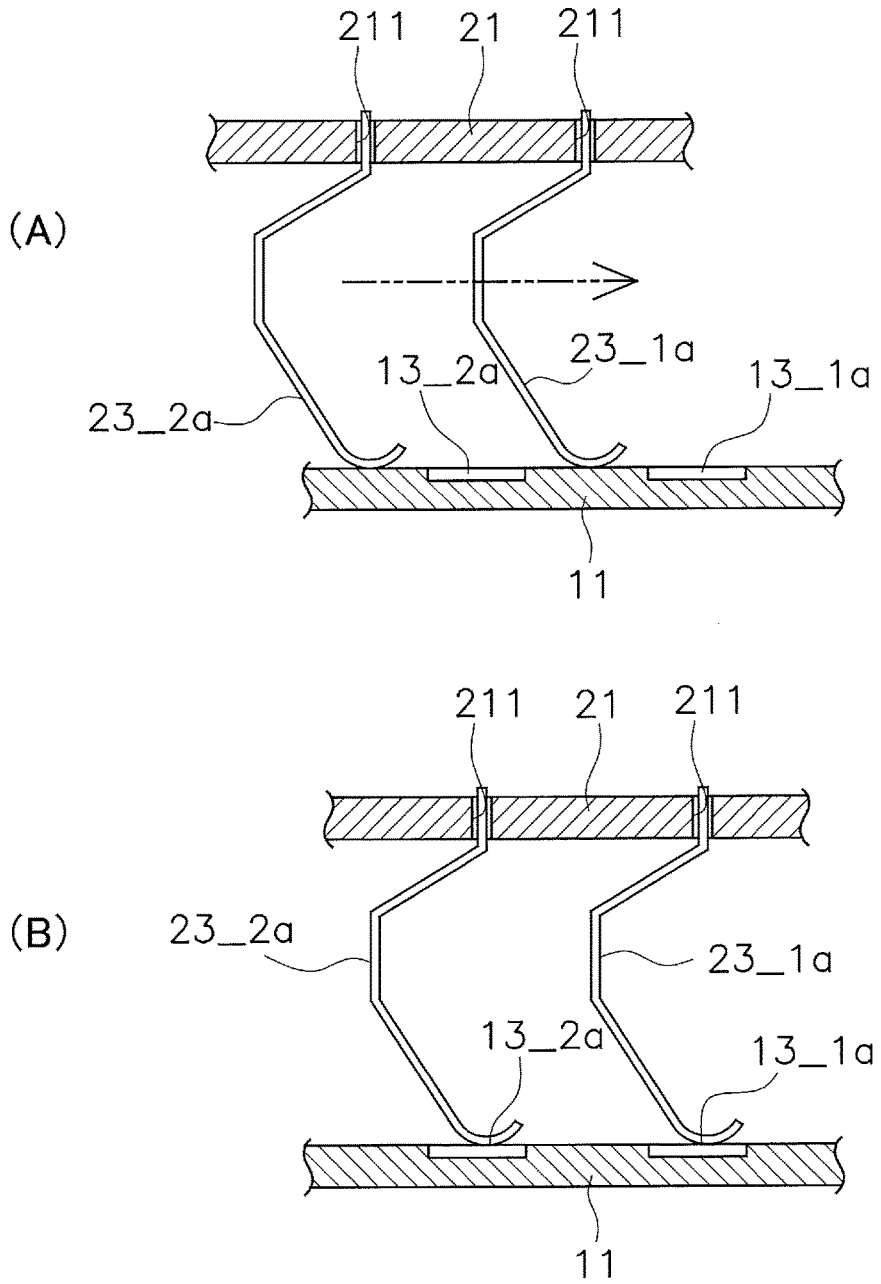
FIG. 10 is a detail view of a slider and the surrounding structure.

FIG. 10 is a detail view of the first slider 23_1*a* and the surrounding structure. The distal end of the first slider 23_1*a* is touching the base substrate 11, and the distal end of the first slider 23_1*a*, which has a shape that is curved in an arc, is pressed against the base substrate 11. Because it is springy, the first slider 23_1*a* is pressed against the base substrate 11 by the elastic force. The first contactor 13_1*a* is disposed aligned with the first slider 23_1*a* in the rotational direction of the movable block 5 on the base substrate 11.

The first contactor 13_2*a* is disposed in the same way as the first contactor 13_1*a*. The first contactor 13_2*a* is disposed aligned with the first contactor 13_1*a* in the rotational direction of the movable block 5. The first contactor 13_2*a* is disposed aligned with the first slider 23_2*a* in the rotational direction of the movable block 5 on the base substrate 11.

When the movable block 5 rotates, the distal end of the first slider 23_1*a* and the distal end of the first slider 23_2*a* slide over the base substrate 11 in a state of being pressed against the base substrate 11. The other sliders 23 are configured the same as the first slider 23_1*a* and the first slider 23_2*a*.

Figure 11:
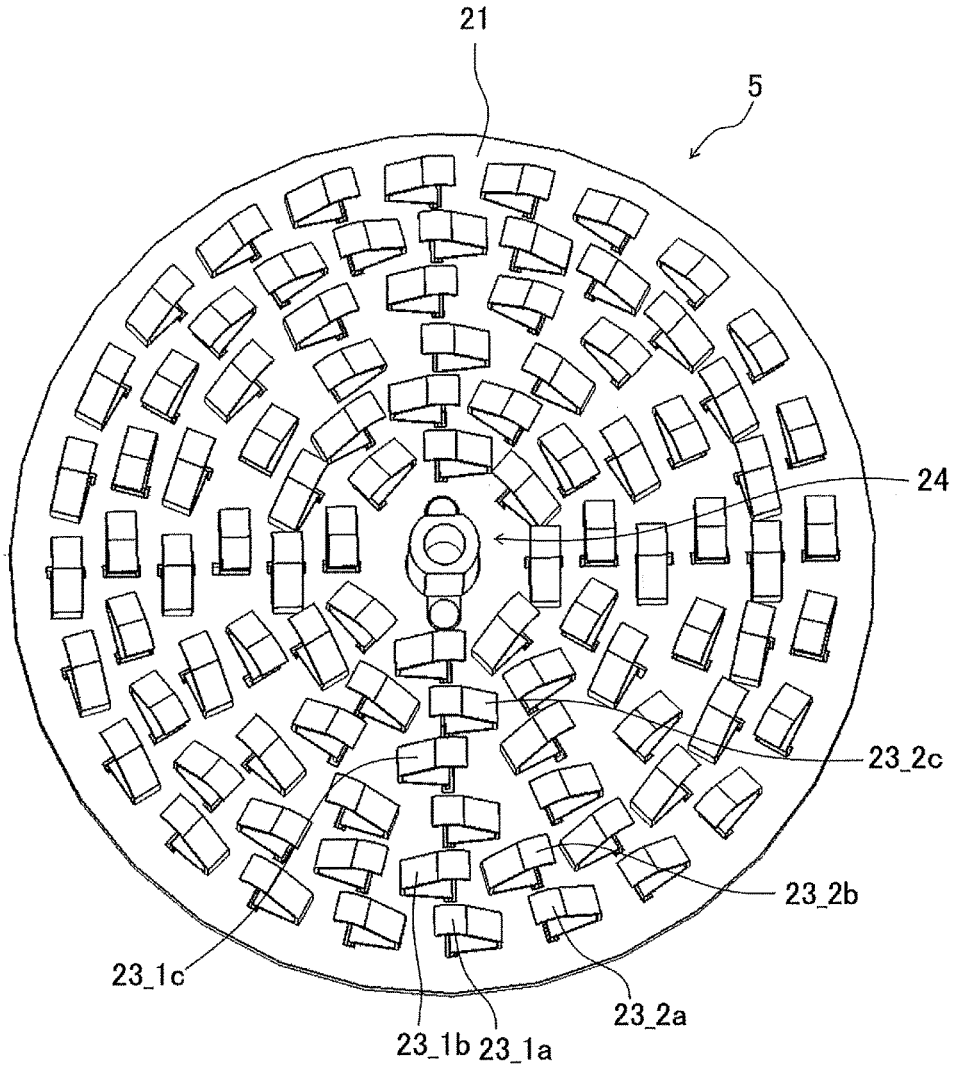
FIG. 11 is an oblique bottom view of the movable block.

FIG. 11 is an oblique bottom view of the movable block 5. As shown in FIG. 11, the sliders 23 have a shape that curves in the peripheral direction of the rotary substrate 21. In other words, the sliders 23 have a shape that curves in the rotational direction of the movable block 5.

More precisely, the sliders 23 have sliders 23 (such as 23_1*a* and 23_2*a*) having a shape that curves in a predetermined rotational direction, and sliders 23 (such as 23_1*b* and 23_2*b*) having a shape that curves in the opposite direction from said predetermined rotational direction. The sliders 23 having a shape that curves toward a predetermined rotational direction, and sliders 23 having a shape that curves toward the opposite direction from said predetermined rotational direction are disposed alternately in the radial direction. Also, the sliders 23 disposed around the same circle are curved in the same direction.

As shown in FIGS. 2 and 7, the armature 22 are attached to the front of the rotary substrate 21. More precisely, the movable block 5 includes a support member 26 that supports the armature 22. The support member 26 is formed from an insulating material, such as a resin. The armature 22 is attached to the rotary substrate 21 via the support member 26.

As shown in FIG. 7, the armature 22 includes a first armature 27, a second armature 28, and a permanent magnet 29. The first armature 27 and the second armature 28 are disposed spaced apart. The first armature 27 and the second armature 28 are disposed parallel to each other.

The first armature 27 and the second armature 28 are formed from a semi-hard magnetic material, for example. However, the first armature 27 and the second armature 28 may be formed from some material other than a semi-hard magnetic material.

The permanent magnet 29 is disposed between the first armature 27 and the second armature 28. As seen in the rotational axis Ra direction, the permanent magnet 29 is disposed overlapping the rotational axis Ra. As seen in the rotational axis Ra direction, the rotational axis Ra is disposed between the first armature 27 and the second armature 28. The first armature 27 and the second armature 28 have a slender shape.

The armature 22 includes a first concave part 221 and a second concave part 222. As seen in the rotational axis Ra direction, the first concave part 221 and the second concave part 222 are disposed symmetrically to the rotational axis Ra. The first concave part 221 is made up of one end of the first armature 27, one end of the second armature 28, and the permanent magnet 29. The second concave part 222 is made up of the other end of the first armature 27, the other end of the second armature 28, and the permanent magnet 29. The first concave part 221 and the second concave part 222 extend in the lengthwise direction of the first armature 27 and the second armature 28, respectively.

Figure 12:
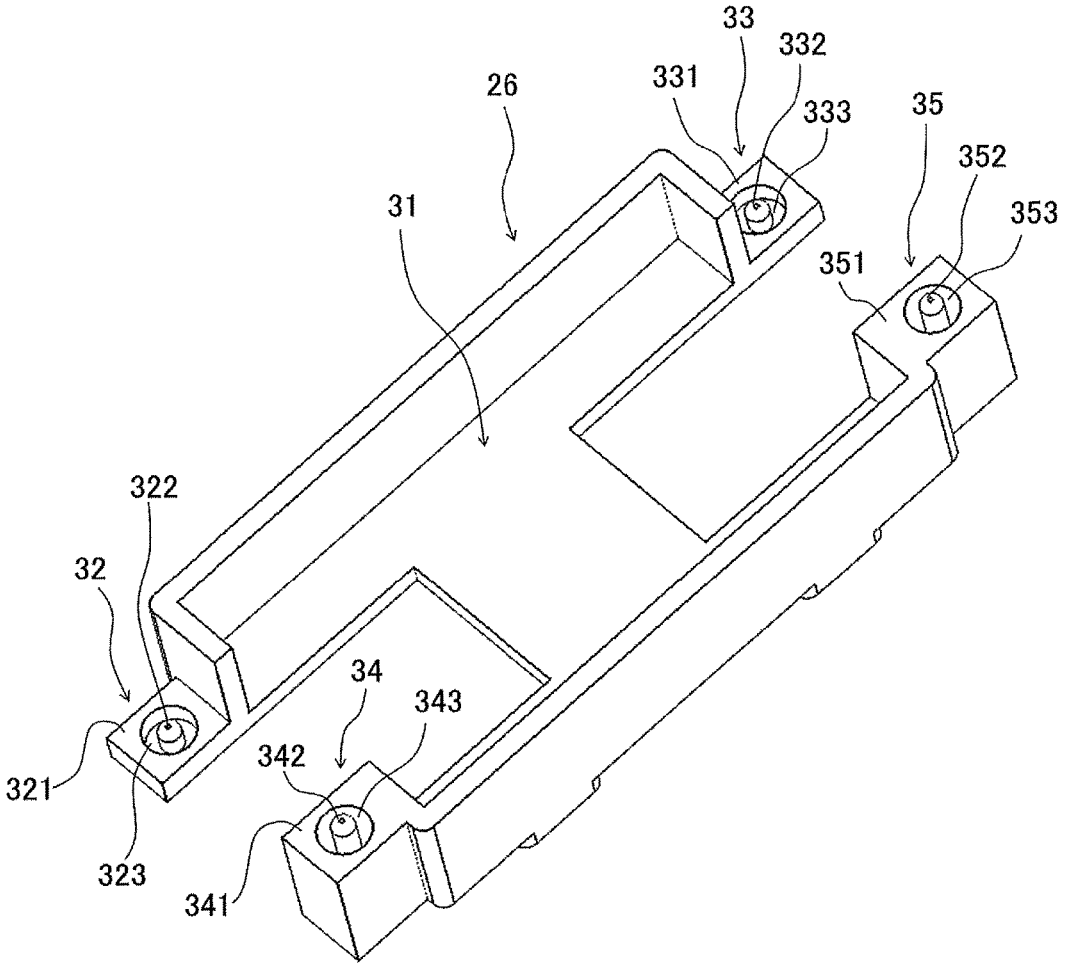
FIG. 12 is an oblique view of a support member as seen obliquely from above.
Figure 13:
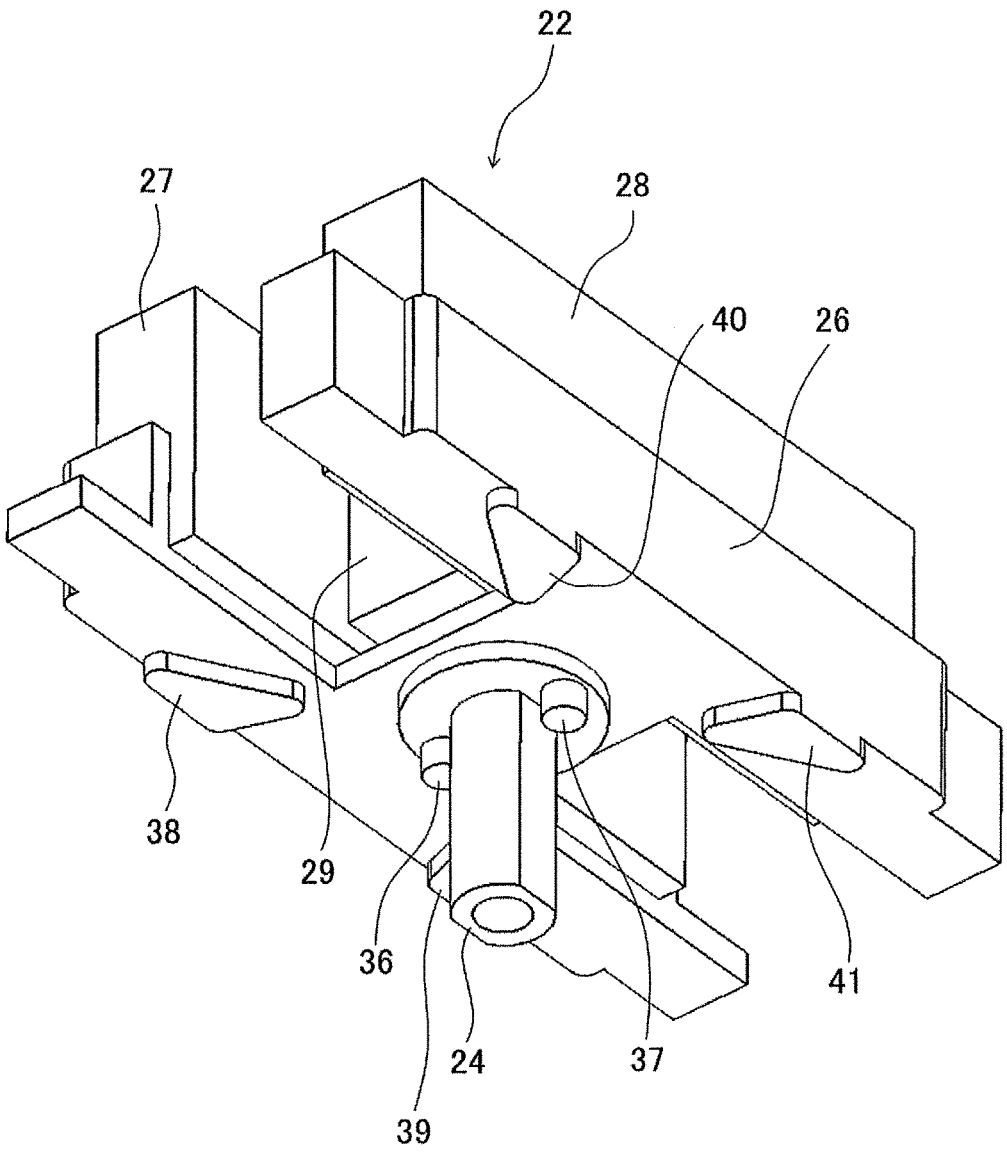
FIG. 13 is an oblique view of the support member and an armature as seen obliquely from below.

FIG. 12 is an oblique view of a support member 26 as seen obliquely from above. FIG. 13 is an oblique view of the support member 26 and the armature 22 as seen obliquely from below. The support member 26 includes a concave part 31 in which the armature 22 is disposed. The support member 26 includes a first support 32 and a second support 33. The first armature 27 is to disposed between the first support 32 and the second support 33. The support member 26 includes a third support 34 and a fourth support 35. The second armature 28 is disposed between the third support 34 and the fourth support 35.

As shown in FIG. 13, the above-mentioned rotary shaft 24 is integrated with the bottom face of the support member 26. Protrusions 36 and 37 are disposed on either side of the rotary shaft 24. As shown in FIG. 9, the rotary substrate 21 includes a through-hole 212. The through-hole 212 includes a circular part 213 and a pair of protrusions 214 and 215. As shown in FIG. 8, the rotary shaft 24 is passed through the circular part 213. Also, the protrusions 36 and 37 are passed through the protrusions 214 and 215, respectively. Consequently, the rotary substrate 21 stops turning with respect to the support member 26. This causes the rotary substrate 21 to rotate along with the armature 22.

Figure 14:
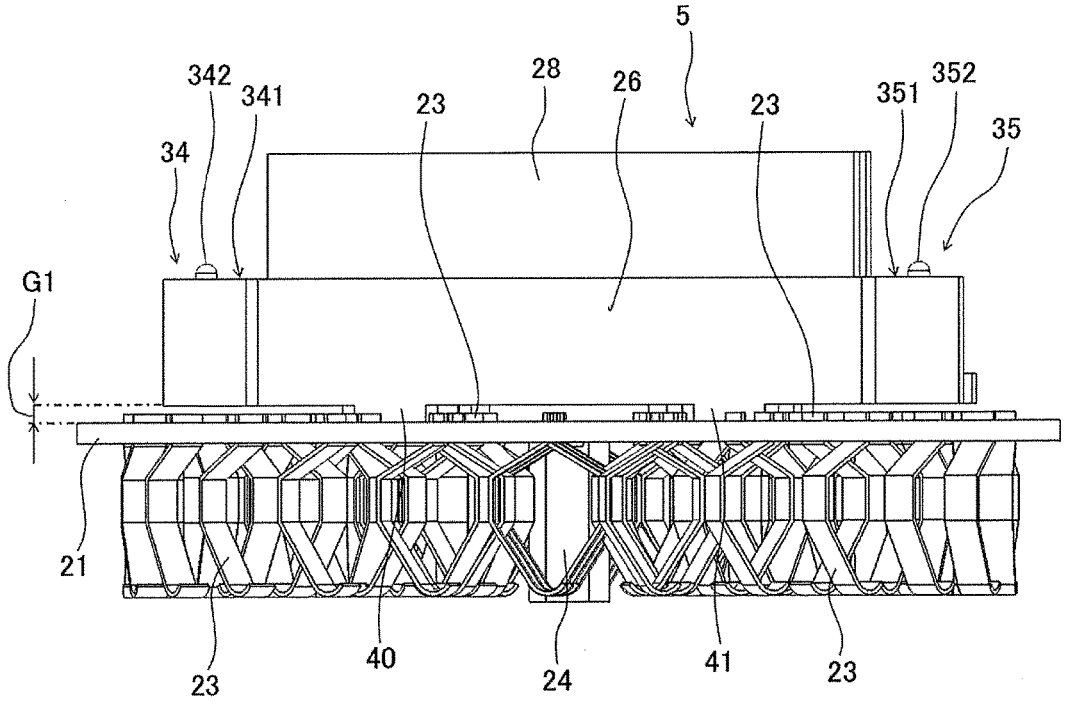
FIG. 14 is a side view of the movable block.

As shown in FIG. 13, a plurality of pads 38 to 41 are disposed on the bottom face of the support member 26. The pads 38 to 41 protrude from the bottom face of the support member 26. The pads 38 to 41 have a flat bottom face. The pads 38 to 41 are disposed around the rotary shaft 24. FIG. 14 is a side view of the movable block 5. As shown in FIG. 14, the pads 38 to 41 provide a gap G1 between the front face of the rotary substrate 21 and the bottom face of the support member 26. This avoids interference between the support member 26 and the ends of the sliders 23 protruding from the front of the rotary substrate 21.

Figure 15:
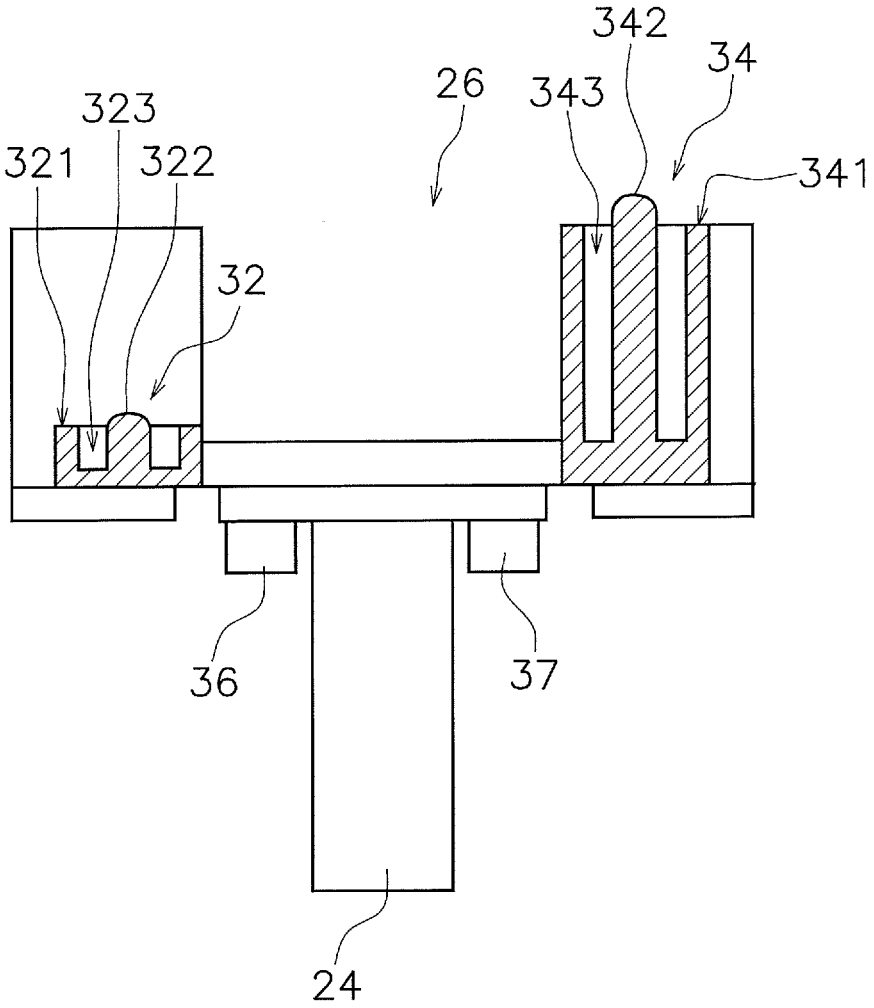
FIG. 15 is a cross section of the support member.

FIG. 15 is a cross section along the XV-XV line of the support member 26 in FIG. 7. As shown in FIG. 15, the first support 32 includes a first upper face 321, a first protrusion 322, and a first concave part 323. The first upper face 321 has a flat shape. The first protrusion 322 protrudes from the first upper face 321. The first concave part 323 is provided around the protrusion.

Similarly, as shown in FIG. 12, the second support 33 includes a second upper face 331, a second protrusion 332, and a second concave part 333. The third support 34 includes a third upper face 341, a third protrusion 342, and a third concave part 343. The fourth support 35 includes a fourth upper face 351, a fourth protrusion 352, and a fourth concave part 353. The second to fourth upper faces 331, 341, and 351, the second to fourth protrusions 332, 342, and 352, and the second to fourth concave parts 333, 343, and 353 are the same as the first upper face 321, the first protrusion 322, and the first concave part 323, respectively, and therefore will not be described in detail.

However, the height of the first and second upper faces 321 and 331 from the rotary substrate 21 is lower than the height of the third and fourth upper faces 341 and 351 from the rotary substrate 21. Also, the height of the first and second protrusions 322 and 332 from the rotary substrate 21 is lower than the height of the third and fourth protrusions 342 and 352 from the rotary substrate 21.

As shown in FIG. 7, the protrusions 322, 332, 342, and 352 are disposed symmetrically to each other around the rotational axis Ra, as seen in the rotational axis Ra direction. These protrusions 322, 332, 342, and 352 are pressed by the coil block 6, causing the support member 26 to be sandwiched between the coil block 6 and the base substrate 11.

Figure 16:
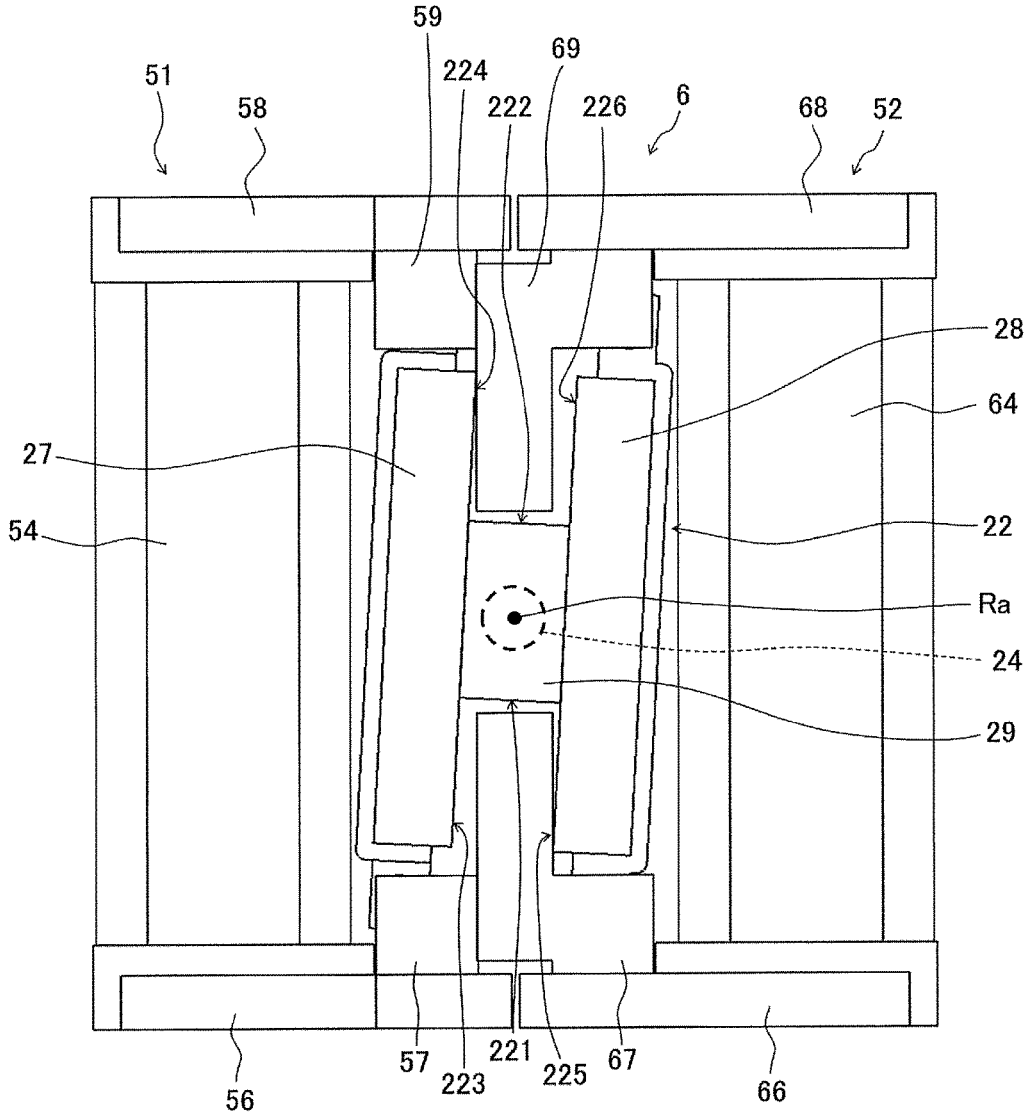
FIG. 16 is a top view of the main body.
Figure 17:
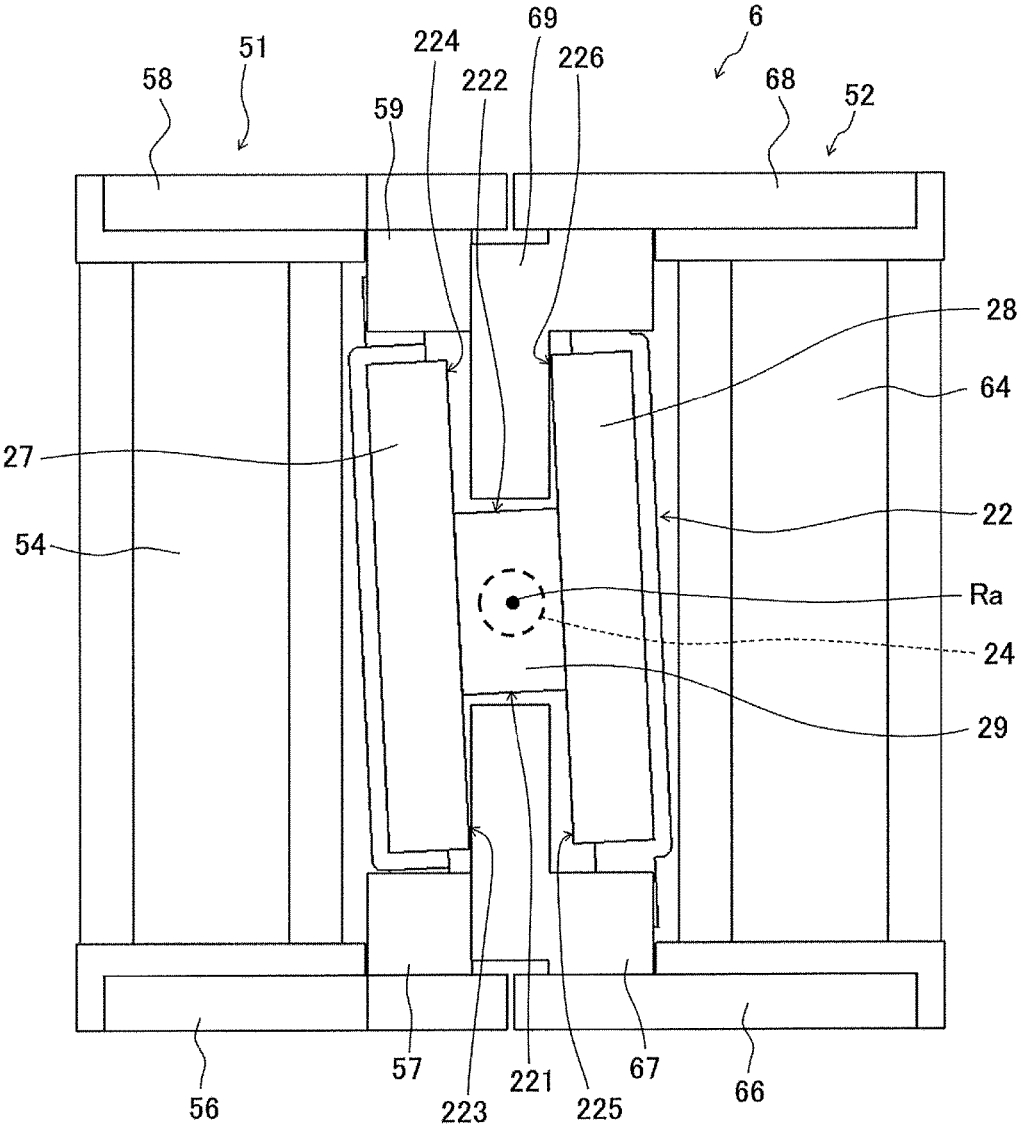
FIG. 17 is a top view of the main body.

The coil block 6 rotates the movable block 5 with respect to the base substrate 11. FIGS. 16 and 17 are top views of the coil block 6 and the armature 22. The coil block 6 rotates the armature 22 in a predetermined direction (counterclockwise in FIGS. 16 and 17) from the position shown in FIG. 16 (hereinafter referred to as the "first position"), thereby moving it to the position shown in FIG. 17 (hereinafter referred to as the "second position"). Also, the coil block 6 rotates the armature 22 in a direction that is opposite said predetermined direction (clockwise in FIGS. 16 and 17) from the second position shown in FIG. 17, thereby moving it to the first position shown in FIG. 16.

Figure 18:
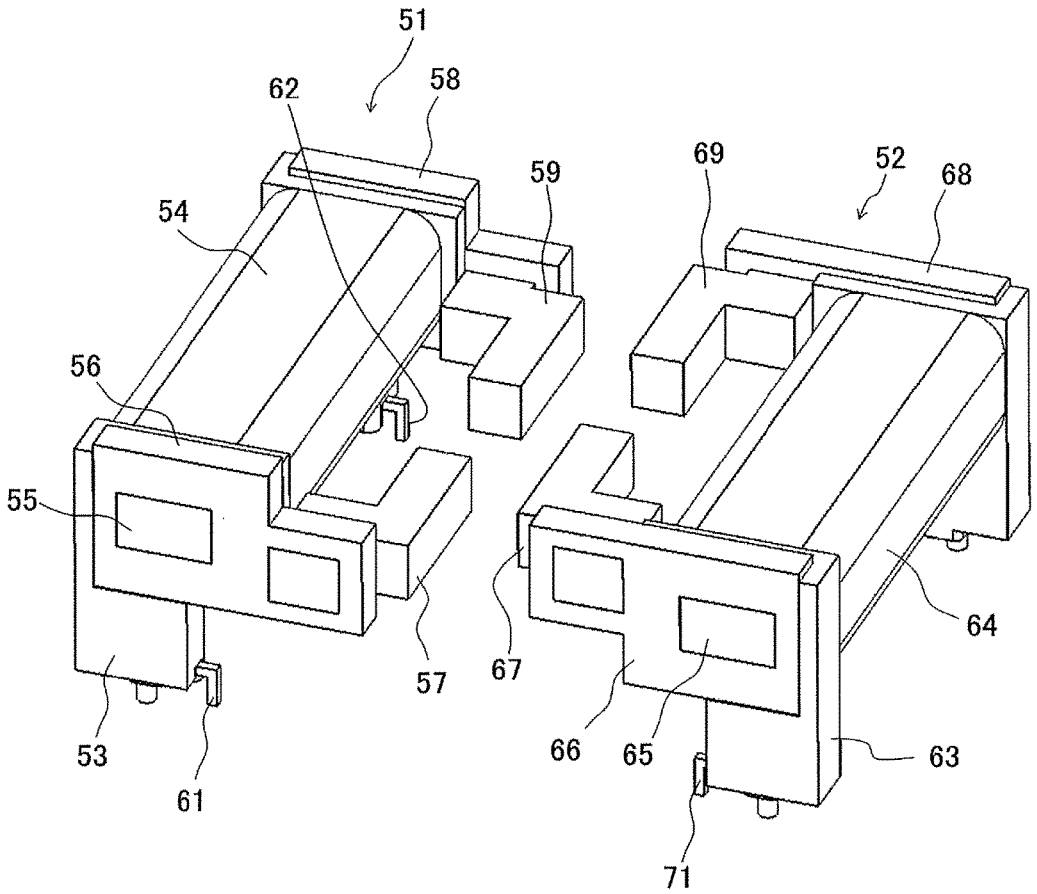
FIG. 18 is a diagram of a first coil unit and a second coil unit.

The coil block 6 includes a first coil unit 51 and a second coil unit 52. FIG. 18 is a diagram of the first coil unit 51 and the second coil unit 52. In FIG. 18, the first coil unit 51 and the second coil unit 52 are shown separated, and the first coil unit 51 and the second coil unit 52 are separate from each other. That is, the magnetic circuit of the first coil unit 51 and the magnetic circuit of the second coil unit 52 are independent of one another.

The first coil unit 51 and the second coil unit 52 are disposed aligned in a direction perpendicular to the rotational axis Ra. The direction in which the first coil unit 51 and the second coil unit 52 are aligned will hereinafter be referred to as the width direction.

Figure 19:
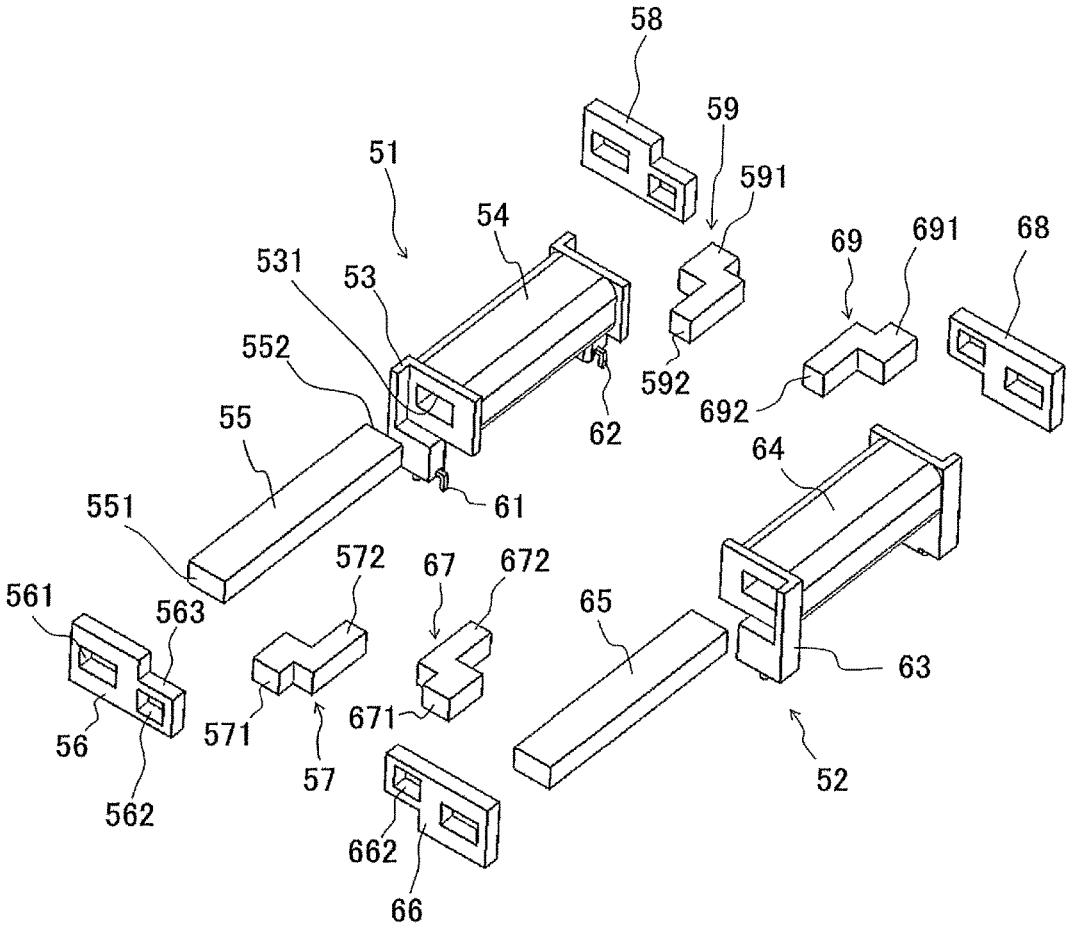
FIG. 19 is an exploded oblique view of the coil block.

FIG. 19 is an exploded oblique view of the coil block 6. As shown in FIG. 19, the first coil unit 51 includes a first coil bobbin 53, a first coil 54, a first core 55, a first linking yoke 56, a first yoke 57, a second linking yoke 58, and a second yoke 59.

The first coil 54 is wound around the first coil bobbin 53. A first coil terminal 61 and a to second coil terminal 62 are attached to the first coil bobbin 53. The first coil terminal 61 and the second coil terminal 62 are connected to the first coil 54. The first coil terminal 61 is inserted into the first coil terminal hole 42 shown in FIGS. 5 and 6. The second coil terminal 62 is inserted into a second coil terminal hole 43.

The first core 55 is disposed in a hole 531 in the first coil bobbin 53. The first core 55 includes a first end 551 and a second end 552. The first end 551 and the second end 552 of the first core 55 protrude from the first coil bobbin 53.

The first linking yoke 56 is connected to the first end 551 of the first core 55. As seen in the rotational axis Ra direction, the first linking yoke 56 extends toward the second coil unit 52. The first linking yoke 56 includes a first opening 561 and a second opening 562. The first end 551 is inserted into the first core 55. The second opening 562 is disposed lower than the first opening 561. The first linking yoke 56 includes a first cutout 563. The first cutout 563 is disposed above the second opening 562.

The first yoke 57 includes a support 571 and a distal end 572. The support 571 is inserted into the second opening 562. The distal end 572 protrudes from the support 571 toward the armature 22.

The second linking yoke 58 is connected to the second end 552 of the first core 55. As seen in the rotational axis Ra direction, the second linking yoke 58 extends toward the second coil unit 52. The second linking yoke 58 and the second yoke 59 have the same shape as the first linking yoke 56 and the first yoke 57, respectively, and therefore will not be described in detail.

The second coil unit 52 includes a second coil bobbin 63, a second coil 64, a second core 65, a third linking yoke 66, a third yoke 67, a fourth linking yoke 68, and a fourth yoke 69. The second coil 64 is disposed away from the first coil 54 in the width direction.

As seen in the rotational axis Ra direction, the third linking yoke 66 and the fourth linking yoke 68 extend toward the first coil unit 51. The third yoke 67 is disposed above the first yoke 57. The fourth yoke 69 is disposed above the second yoke 59.

The second coil bobbin 63 has the same shape as the first coil bobbin 53. A third coil terminal 71 and a fourth coil terminal 72 (see FIG. 3) are attached to the second coil bobbin 63. The third coil terminal 71 and the fourth coil terminal 72 are connected to the second coil 64. The third coil terminal 71 is inserted into the third coil terminal hole 44 shown in FIGS. 5 and 6. The fourth coil terminal 72 is inserted into the fourth coil terminal hole 45 shown in FIGS. 5 and 6. The above-mentioned first coil terminal hole 42 and fourth coil terminal hole 45 are through-holes, and are electrically connected to a first external coil terminal 46. The above-mentioned second coil terminal hole 43 and third coil terminal hole 44 are through-holes, and are electrically connected to a second external coil terminal 47.

The second core 65 has the same shape as the first core 55. The first to fourth linking yokes 56, 58, 66, and 68 all have the same shape. The first to fourth yokes 57, 59, 67, and 69 all have the same shape. Therefore, for these parts, parts of the same shape can be shared by changing the orientation of their disposition.

Figure 20:
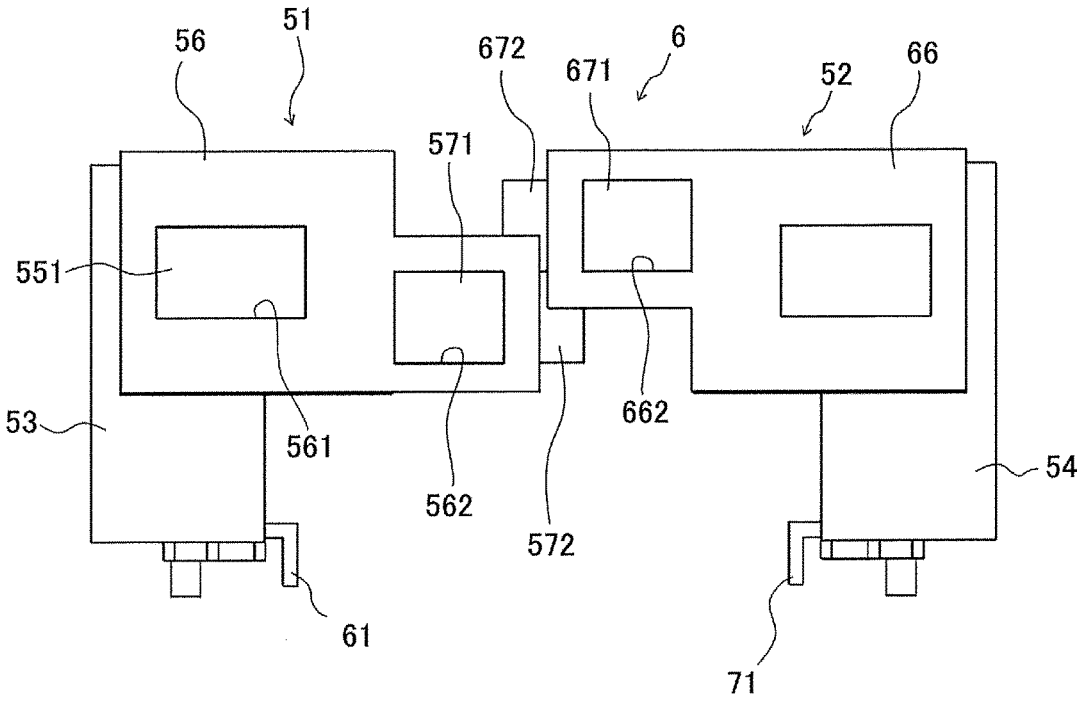
FIG. 20 is a diagram of the coil block as seen in the axial direction of the first coil and the second coil.

In particular, the first linking yoke 56 and the third linking yoke 66 are vertically inverted with respect to one another. FIG. 20 is a diagram of the coil block 6 as seen in the axial direction of the first coil 54 and the second coil 64. As shown in FIG. 20, the third linking yoke 66 is vertically inverted with respect to the first linking yoke 56, so that the position of a second opening 662 of the third linking yoke 66 is shifted in the vertical direction from the position of the second opening 562 of the first linking yoke 56. That is, the second opening 662 of the third linking yoke 66 is disposed higher than the second opening 562 of the first linking yoke 56. Accordingly, the positions of the first yoke 57 and the third yoke 67 are offset vertically. Consequently, in a state in which the first coil unit 51 and the second coil unit 52 have been put together, the first yoke 57 and the third yoke 67 overlap vertically. More precisely, the distal end 572 of the first yoke 57 and the distal end 672 of the third yoke 67 are disposed so as to be stacked in the vertical direction.

Similarly, the second linking yoke 58 and the fourth linking yoke 68 are also vertically inverted with respect to one another. Consequently, in a state in which the first coil unit 51 and the second coil unit 52 have been put together, the second yoke 59 and the fourth yoke 69 overlap vertically. More precisely, the distal end 592 of the second yoke 59 and the distal end 692 of the fourth yoke 69 are disposed so as to be stacked in the vertical direction.

The above-mentioned first protrusion 322 of the support member 26 touches and supports the support 571 of the first yoke 57. The second protrusion 332 touches and supports the support 591 of the second yoke 59. The third protrusion 342 touches and supports the support 671 of the third yoke 67. The fourth protrusion 352 touches and supports the support 691 of the fourth yoke 69. The first yoke 57 is disposed under the third yoke 67. Therefore, as discussed above, in regard to the height from the rotary substrate 21, the first protrusion 322 is lower than the third protrusion 342. Also, the second yoke 59 is disposed under the fourth yoke 69. Therefore, as discussed above, the first protrusion 322 is lower than the fourth protrusion 352.

The first core 55, the first linking yoke 56, the first yoke 57, the second linking yoke 58, and the second yoke 59 are formed from a semi-hard magnetic material, for example. Also, the second core 65, the third linking yoke 66, the third yoke 67, the fourth linking yoke 68, and the fourth yoke 69 are formed from a semi-hard magnetic material. However, these parts may be formed from some material other than a semi-hard magnetic material.

As shown in FIGS. 16 and 17, the first coil 54 and the second coil 64 are disposed spaced apart. The armature 22 is disposed between the first coil 54 and the second coil 64. The first yoke 57 and the third yoke 67 protrude toward the armature 22 in between the first coil 54 and the second coil 64. The second yoke 59 and the fourth yoke 69 protrudes toward the armature 22 from the side opposite the first yoke 57 and the third yoke 67, in between the first coil 54 and the second coil 64.

The distal end of the first yoke 57 and the distal end of the third yoke 67 are disposed in the first concave part 221 of the armature 22. The distal end of the second yoke 59 and the distal end of the fourth yoke 69 are disposed in the second concave part 222 of the armature 22. As seen in the rotational axis Ra direction, the permanent magnet 29 and the rotary shaft 24 are disposed between the first yoke 57 and the second yoke 59. Also, the permanent magnet 29 and the rotary shaft 24 are disposed between the third yoke 67 and the fourth yoke 69.

Figure 21:
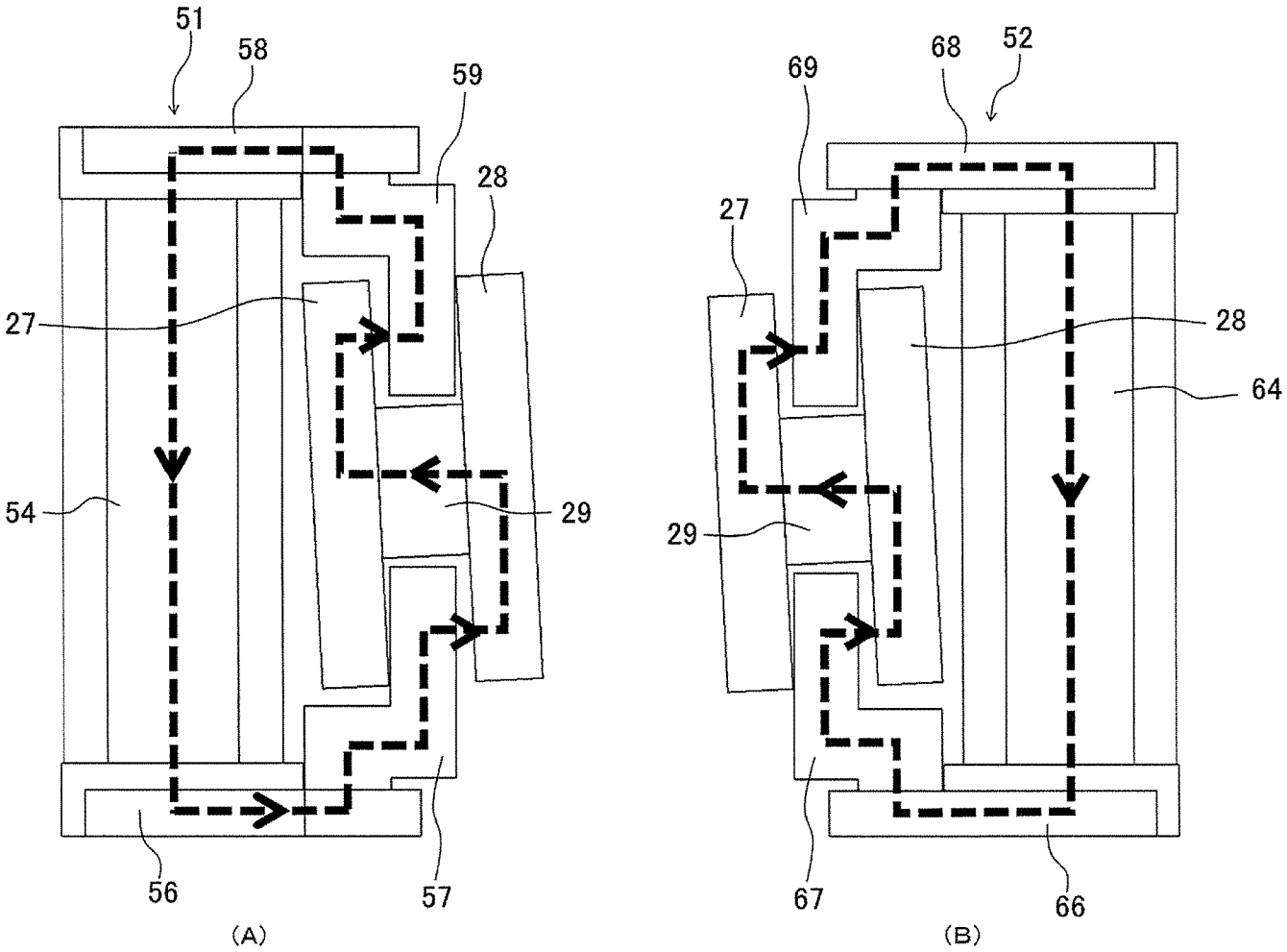
FIG. 21 consists of diagrams of the flow of magnetic flux in the first coil unit and the second coil unit.

FIG. 21A is a diagram of the flow of magnetic flux in the first coil unit 51. FIG. 21B is a diagram of the flow of magnetic flux in the second coil unit 52. As shown in FIG. 21A, when power is sent to the first coil 54 of the first coil unit 51, this produces a flow of magnetic flux, which flows to the first linking yoke 56, the first yoke 57, the second armature 28, the permanent magnet 29, the first armature 27, the second yoke 59, and the second linking yoke 58, in that order.

Figure 22:
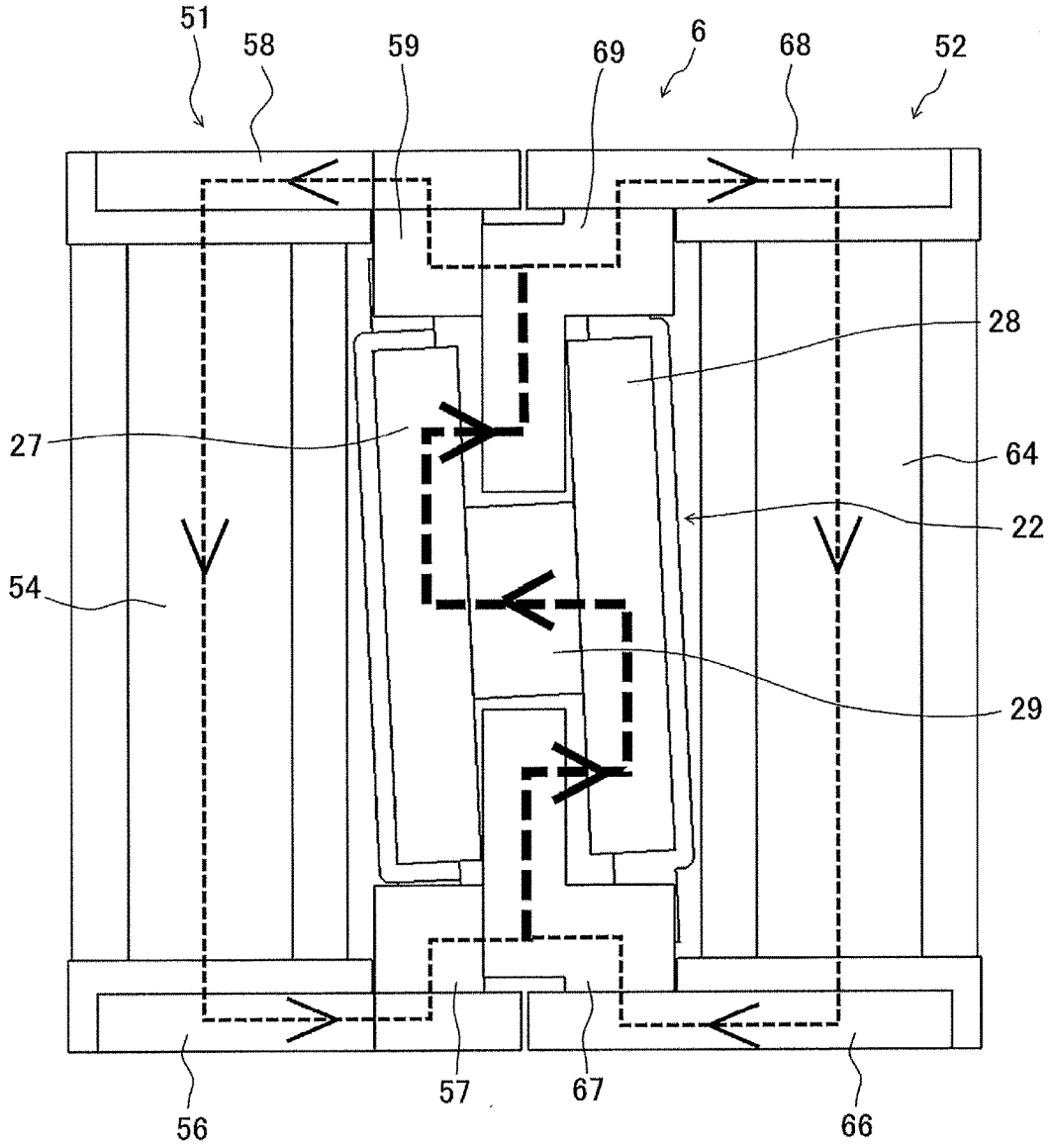
FIG. 22 is a diagram of the flow of magnetic flux in the coil block.

As shown in FIG. 21B, when power is sent to the second coil 64 of the second coil unit 52, this produces a flow of magnetic flux, which flows to the third linking yoke 66, the third yoke 67, the second armature 28, the permanent magnet 29, the first armature 27, the fourth yoke 69, and the fourth linking yoke 68, in that order. Therefore, as shown in FIG. 22, the magnetic flux of the first coil unit 51 and the magnetic flux of the second coil unit 52 overlap in the same direction in the armature 22, so a strong electromagnetic force acts on the armature 22. Consequently, a powerful attractive force acts between the first armature 27 and the second yoke 59, between the first armature 27 and the fourth yoke 69, between the second armature 28 and the first yoke 57, and between the second armature 28 and the third yoke 67. As a result, the armature 22 rotates in a predetermined direction (counter-clockwise in FIG. 22), which is accompanied by rotation of the movable block 5 in the predetermined direction as well.

Figure 23:
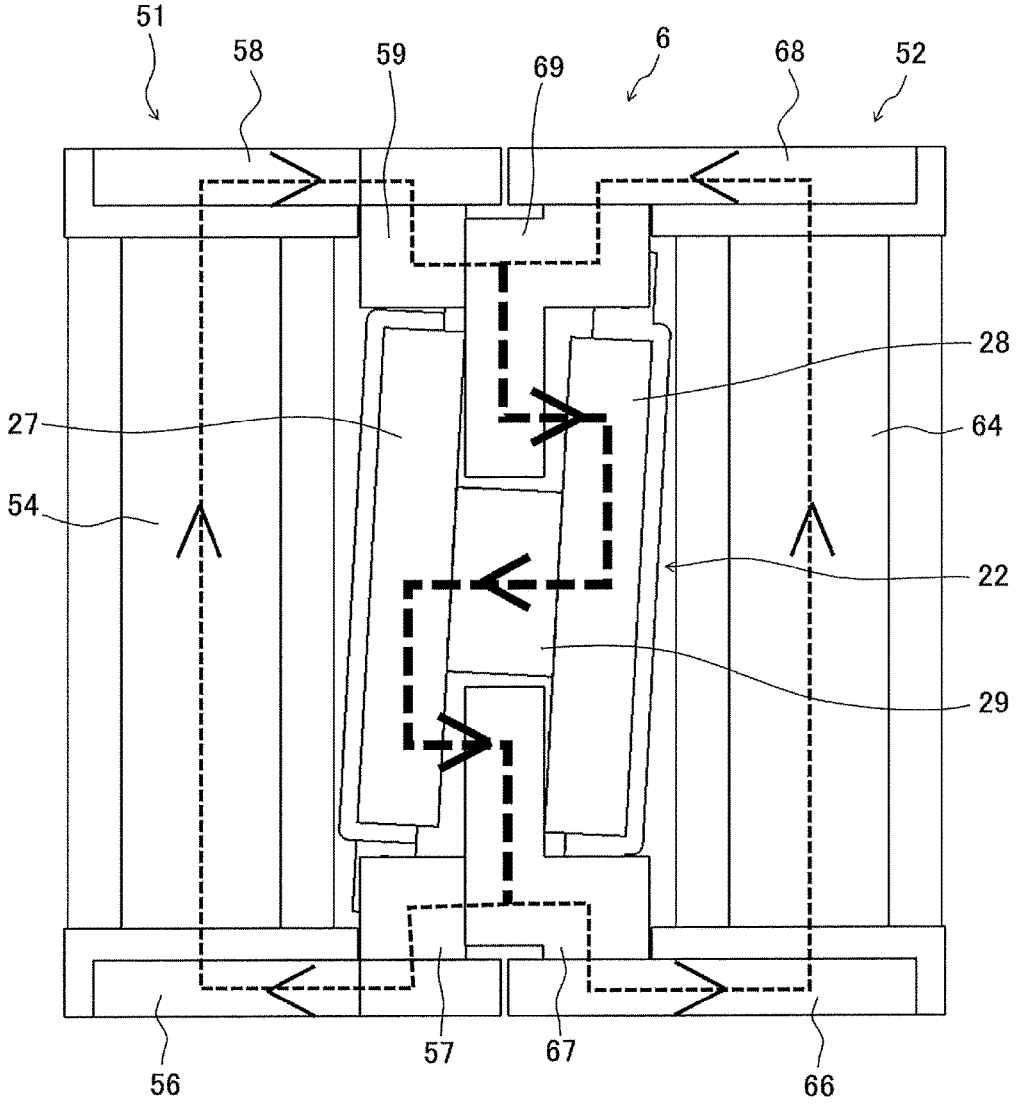
FIG. 23 is a diagram of the flow of magnetic flux in the coil block.

When the direction of current flow through the first coil 54 and the second coil 64 is reversed from the above direction, as shown in FIG. 23, the flow of magnetic flux in the first coil unit 51, the second coil unit 52, and the armature 22 is the reverse of the above. Consequently, a powerful attractive force acts between the first armature 27 and the first yoke 57, between the first armature 27 and the third yoke 67, between the second armature 28 and the second yoke 59, and between the second armature 28 and the fourth yoke 69. As a result, the armature 22 rotates in the opposite direction from said predetermined direction (clockwise in FIG. 23), which is accompanied by rotation of the movable block 5 in the opposite direction from said predetermined direction as well.

As shown in FIG. 16 and relay 17, the armature 22 includes a first contact part 223, a second contact part 224, a third contact part 225, and a fourth contact part 226. More precisely, the first contact part 223 is the inner face of one end of the first armature 27. The second contact part 224 is the inner face of the other end of the first armature 27. The third contact part 225 is the inner face of one end of the second armature 28. The fourth contact part 226 is the inner face of the other end of the second armature 28.

As shown in FIG. 17, when the armature 22 rotates in a predetermined direction (counter-clockwise in FIG. 17), the first contact part 223 comes into contact with the first yoke 57 and the third yoke 67. Also, the fourth contact part 226 comes into contact with the second yoke 59 and the fourth yoke 69. This restricts the rotation of the armature 22. Therefore, when the movable block 5 rotates in the predetermined direction, the first contact part 223 and the fourth contact part 226 come into contact with the coil block 6, which restricts the amount of rotation of the movable block 5 in the predetermined direction.

As shown in FIG. 16, when the armature 22 rotates in the opposite direction from said predetermined direction (clockwise in FIG. 16), the second contact part 224 comes into contact with the second yoke 59 and the fourth yoke 69. Also, the third contact part 225 comes into contact with the first yoke 57 and the third yoke 67. This restricts the rotation of the armature 22. Therefore, when the movable block 5 rotates in the opposite direction from said predetermined direction, the second contact part 224 and the third contact part 225 come into contact with the coil block 6, which restricts the amount of rotation of the movable block 5 in the predetermined direction.

Figure 24:
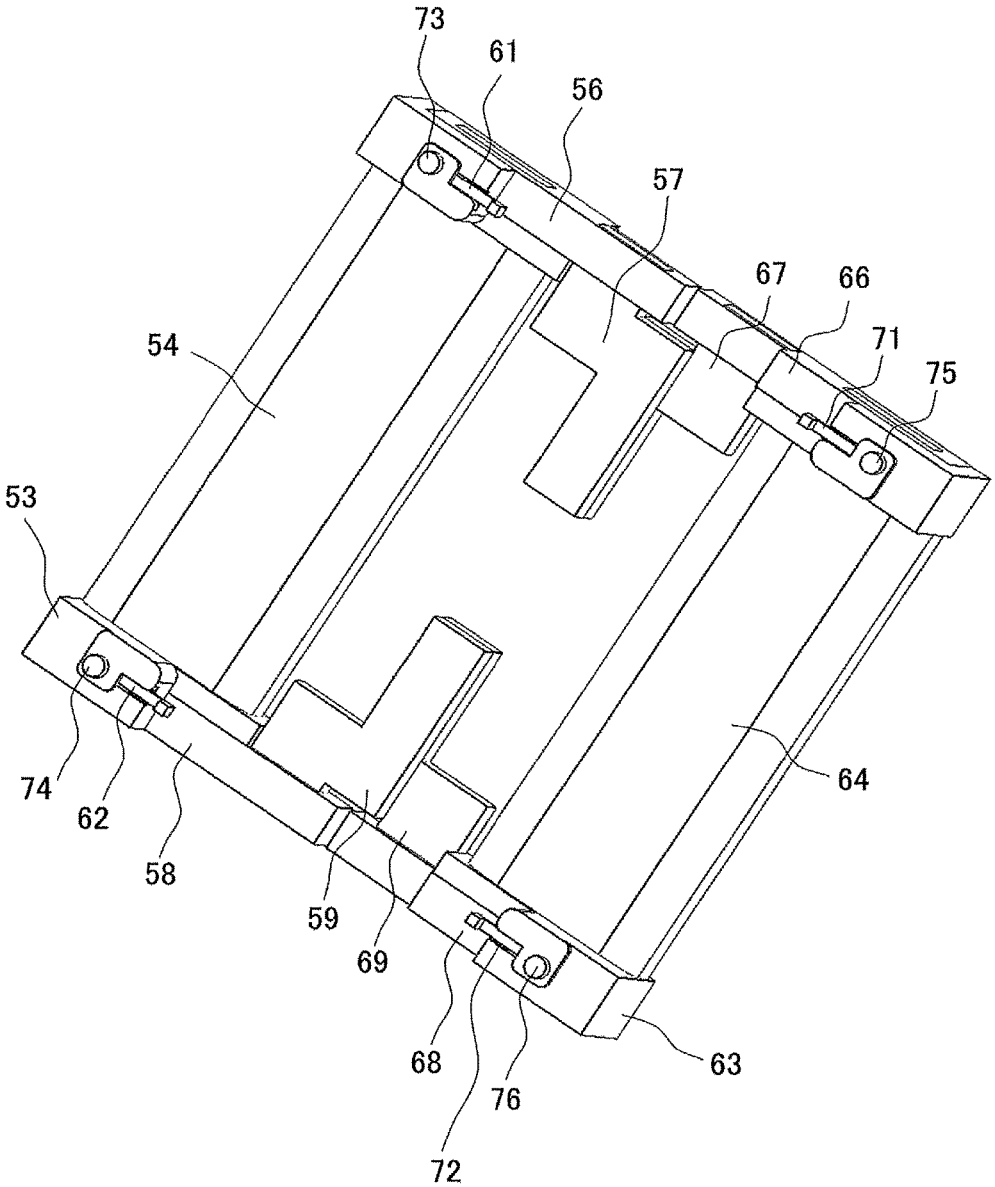
FIG. 24 is an oblique view of the coil block as seen from below.

The coil block 6 is attached to the base substrate 11. FIG. 24 is an oblique view of the coil block 6 as seen from below. As shown in FIG. 24, the coil block 6 includes a plurality of fixing protrusions 73 to 76. More precisely, the first coil bobbin 53 includes a first fixing protrusion 73 and a second fixing protrusion 74. The first fixing protrusion 73 and the second fixing protrusion 74 are provided to the bottom face of both ends of the first coil bobbin 53. The second coil bobbin 63 includes a third fixing protrusion 75 and a fourth fixing protrusion 76. The third fixing protrusion 75 and the fourth fixing protrusion 76 are provided to the bottom face of both ends of the second coil bobbin 63.

As shown in FIG. 3, a plurality of fixing holes 81 to 84 are provided to the base block 4. The fixing holes 81 to 84 are disposed corresponding to the fixing protrusions 73 to 76 of the coil block 6. The fixing protrusions 73 to 76 are inserted into these fixing holes 81 to 84, and are fixed therein by an adhesive agent, cold press-fitting, or another such fixing means. When the coil block 6 is attached to the base substrate 11, the movable block 5 is pressed toward the base substrate 11.

The operation to switch the continuity state of the sliders 23 and the contactors 13 in the relay 1 pertaining to this embodiment will now be described. With the relay 1 pertaining to this embodiment, the sliders 23 and the contactors 13 are switched in and out of contact when the movable block 5 rotates with respect to the base substrate 11. With the relay 1 pertaining to this embodiment, the distal ends of the sliders 23 correspond to movable contacts, and the contactors 13 correspond to fixed contacts. When the distal ends of the sliders 23 come into contact with the contactors 13, there is continuity between the sliders 23 and the contactors 13. Specifically, the movable contacts and the fixed contacts enter their ON state. When the distal ends of the sliders 23 move away from the contactors 13, there is no continuity between the sliders 23 and the contactors 13. Specifically, the movable contacts and the fixed contacts enter their OFF state.

Figure 25:
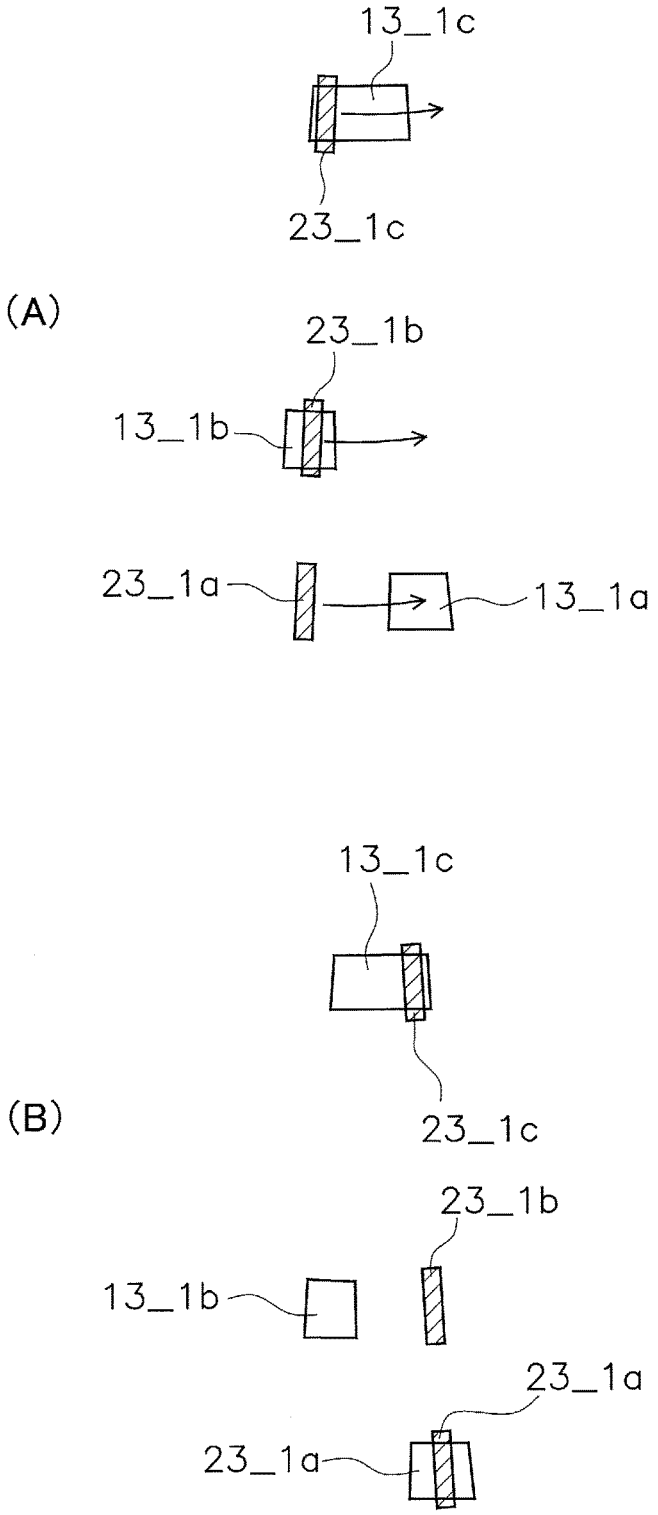
FIG. 25 consists of schematic views of the layout of some of the sliders and some of the contactors.

FIG. 25 consists of schematic views of the layout of some of the sliders and some of the contactors. More precisely, FIG. 25 shows the layout of the above-mentioned first to third sliders 23_1*a*, 23_1*b*, and 23_1*c* (see FIG. 9), and the first to third contactors 13_1*a*, 13_1*b*, and 13_1*c* (see FIG. 5). In FIG. 25A, the movable block 5 is located at the first position shown in FIG. 16. In FIG. 25B, the movable block 5 is located at the second position shown in FIG. 17.

As shown in FIG. 25, the first contactor 13_1*a* is disposed aligned with the first slider 23_1*a* in the rotational direction of the movable block 5. The third contactor 13_1*c* is disposed aligned with the third slider 23_1*c* in the rotational direction of the movable block 5. The second contactor 13_1*b* is disposed aligned with the second slider 23_1*b* in the rotational direction of the movable block 5.

As shown in FIG. 25A, when the movable block 5 is in the first position, the first slider 23_1*a* is not in contact with the first contactor 13_1*a*, and is in contact with the insulating layer of the base substrate 11. The third slider 23_1*c* is in contact with the third contactor 13_1*c*, and the second slider 23_1*b* is in contact with the second contactor 13_1*b*. Therefore, there is continuity between the second slider 23_1*b* and the second contactor 13_1*b*, but no continuity between the first slider 23_1*a* and the first contactor 13_1*a*. Consequently, the second terminal connector 14_1*b* shown in FIG. 6 is electrically connected to the third terminal connector 14_1*c* via the second contactor 13_1*b*, the second slider 23_1*b*, the third slider 23_1*c*, and the third contactor 13_1*c*. Also, the first terminal connector 14_1*a* is electrically isolated from the third terminal connector 14_1*c*.

When the movable block 5 rotates in a predetermined direction (counter-clockwise in FIG. 25), the movable block 5 moves from the first position to the second position. As shown in FIG. 25B, when the movable block 5 is in the second position, the first slider 23_1*a* is in contact with the first contactor 13_1*a*, and the third slider 23_1*c* is in contact with the third contactor 13_1*c*. The second slider 23_1*b* is not in contact with the second contactor 13_1*b*, and is in contact with the insulating layer of the base substrate 11. Therefore, there is continuity between the first slider 23_1*a* and the first contactor 13_1*a*, but no continuity between the second slider 23_1*b* and the second contactor 13_1*b*. Consequently, the first terminal connector 14_1*a* is electrically connected to the third terminal connector 14_1*c* via the first contactor 13_1*a*, the first slider 23_1*a*, the third slider 23_1*c*, and the third contactor 13_1*c*. Also, the second terminal connector 14_1*b* is electrically isolated from the third terminal connector 14_1*c*.

As discussed above, when the coil block 6 rotates the movable block 5 in a predetermined direction from the first position to the second position, the first slider 23_1*a* moves from a non-contact position to a contact position with respect to the first contactor, and the second slider 23_1*b* moves from a contact position to a non-contact position with respect to the second contactor 13_1*b*. The third slider 23_1*c* is always in contact with the third contactor 13_1*c*.

Also, as the above-mentioned first to third sliders 23_1*a*, 23_1*b*, and 23_1*c* move, the other sliders, including the first to third sliders 23_2*a*, 23_2*b*, and 23_2*c*, also move. Therefore, as shown in FIG. 10, the first slider 23_2*a* moves from a non-contact position in which it is not in contact with the first contactor 13_2*a* (see FIG. 10A) to a position where it is in contact with the first contactor 13_2*a* (see FIG. 10B). Although not depicted in the drawings, the third slider 23_2*c* and the second slider 23_2*b* also move in the same way as the above-mentioned third slider 23_1*c* and the second slider 23_1*b*. Consequently, there is continuity between the first sliders including the first sliders 23_1*a* and 23_2*a* and the first contactors corresponding thereto. Also, there is no continuity between the second sliders including the second sliders 23_1*b* and 23_2*b* and the second contactors corresponding thereto.

In a state in which the movable block 5 is in the second position, even if power to the coil block 6 is shut off, the movable block 5 will be held in the second position by the magnetic force of the permanent magnet 29 and by the frictional force between the sliders 23 and the base substrate 11.

When the movable block 5 is rotated in the opposite direction from the predetermined direction and moved from the second position to the first position, the contact state returns from the state shown in FIG. 25B to the state shown in FIG. 25A. Specifically, the first slider 23_1*a* moves from a contact position to a non-contact position with respect to the first contactor 13_1*a*, and the second slider 23_1*b* moves from a non-contact position to a contact position with respect to the second contactor 13_1*b*. The third slider 23_1*c* is always in contact with the third contactor 13_1*c*.

Also, as the above-mentioned first to third sliders 23_1*a*, 231*b*, and 23_1*c* move, the other sliders including the first to third sliders 23_2*a*, 23_2*b*, and 23_2*c*, also move. Consequently, there is no continuity between the first sliders including the first sliders 23_1*a* and 23_2*a* and the first contactors corresponding thereto. There is continuity between the second sliders including the second sliders 23_1*b* and 23_2*b* and the second contactors corresponding thereto.

In a state in which the movable block 5 is in the first position, even if power to the coil block 6 is shut off, the movable block 5 will be held in the first position by the magnetic force of the permanent magnet 29 and by the frictional force between the sliders and the base substrate 11.

As discussed above, the rotational direction of the movable block 5 can be switched so as to alternately switch between a continuity state of the sliders and contactors that function the same as a plurality of NO contacts, and the continuity state of the sliders and contactors that function the same as a plurality of NC contacts.

As described above, with the relay 1 pertaining to this embodiment, when the movable block 5 rotates under the electromagnetic force of the coil block 6, the sliders 23 slide over the base substrate 11. Consequently, when the sliders 23 move to a position of contact with the contactors 13, there is continuity between the sliders 23 and the contactors 13. Also, when the sliders 23 slide over the base substrate 11 and move to a position where there are no contactors 13, there is no continuity between the sliders 23 and the contactors 13.

Thus, the continuity state between the sliders 23 and the contactors 13 is switched by moving the sliders 23 while they are still in contact with the base substrate 11. Therefore, the continuity state can be switched while keeping the contact pressure of the sliders 23 constant, so contact reliability between the sliders 23 and the contactors 13 can be easily improved. In particular, the sliders 23 are pressed against the base substrate 11 by elastic force by sandwiching the movable block 5 between the coil block 6 and the base block 4. Consequently, the contact pressure between the sliders 23 and the contactors 13 is maintained, so contact reliability between the sliders 23 and the contactors 13 can be further enhanced.

Many sliders 23 can be disposed in a small space on the rotary substrate 21, and many contactors 13 can be disposed in a small space on the base substrate 11. Therefore, the number of sliders 23 on the rotary substrate 21 and the number of contactors 13 on the base substrate 11 can be increased, which makes it easy to increase the number of pairs of sliders and contactors (the number of contact poles) that participate in the switching of the continuity state while avoiding an increase in size. Also, the contact configuration and the number of pairs of sliders and contactors that participate in the switching of the continuity state can be changed by changing the layout of the sliders 23, the wiring pattern of the rotary substrate 21, and the wiring pattern of the base substrate 11.

Figure 26:
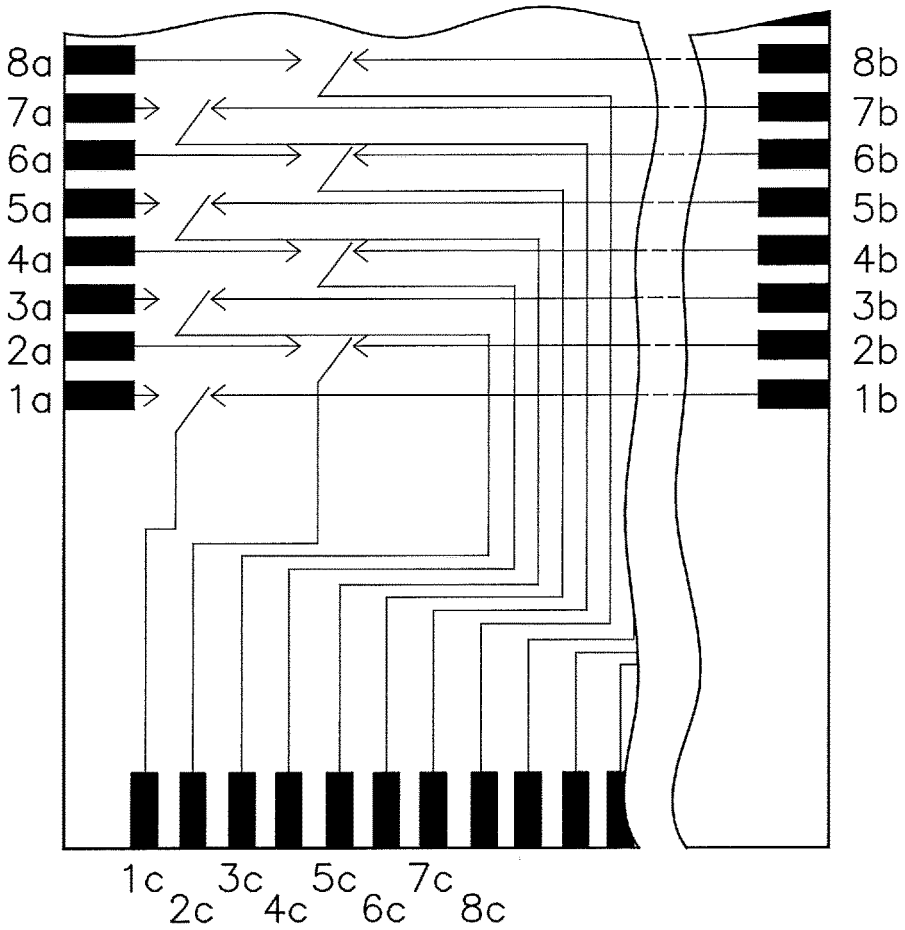
FIG. 26 is a diagram of an example of a base substrate pattern.

For instance, FIG. 26 shows an example of the contact configuration of the relay 1. FIG. 26 shows part of the wiring diagram for the base substrate 11 of the relay 1. In FIG. 26, 1*a* to 8*a*, 1*b* to 8*b*, and 1*c* to 8*c* indicate the contact configurations produced by the above-mentioned terminal connectors 14. With the pattern of the base substrate 11 shown in FIG. 26, 1*a* to 8*a*, 1*b* to 8*b*, and 1*c* to 8*c* are provided so as to be paired up with each other.

Figure 27:
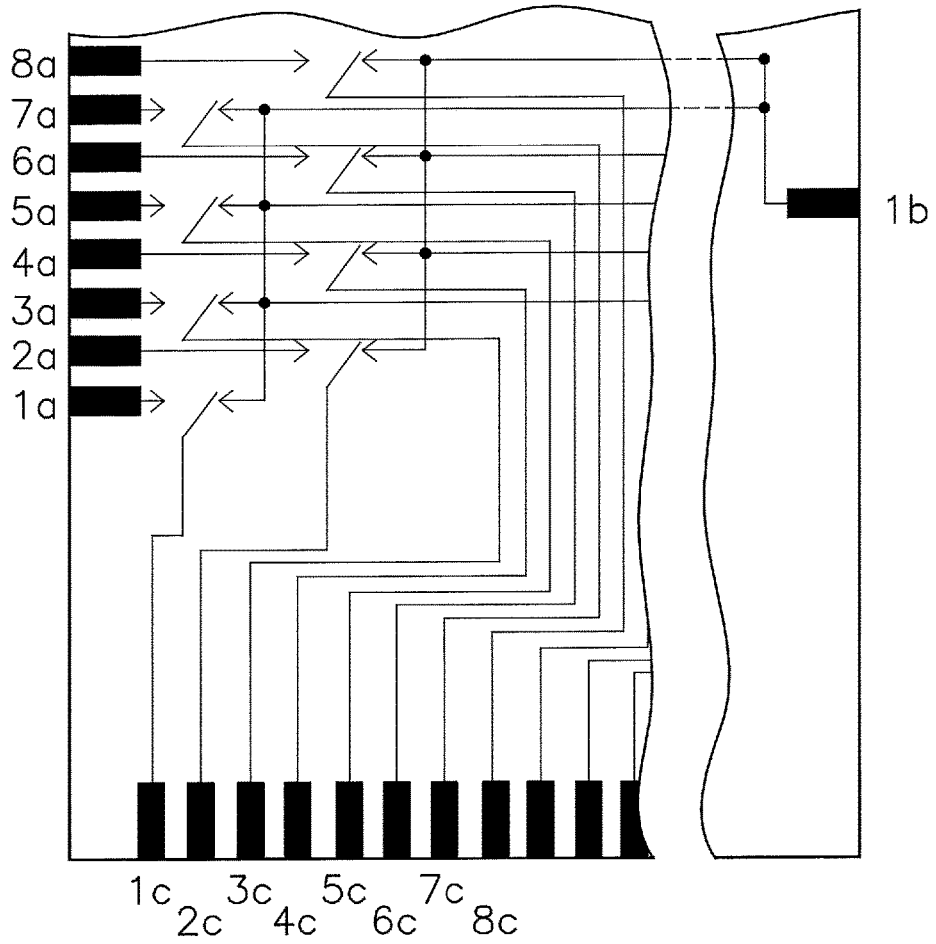
FIG. 27 is a diagram of another example of a base substrate pattern.

FIG. 27 shows another example of the contact configuration of the relay 1. With the pattern of the base substrate 11 shown in FIG. 27, 1*b* is a common terminal for 1*a* to 8*a*. That is, the second contactors 13 corresponding to 1*b* to 8*b* in FIG. 26 are connected to the terminal connector 14 (1*b*) serving as the common terminal by the pattern on the base substrate 11.

In this case the number of terminals can be reduced. Consequently, mounting reliability can be increased by increasing the distance between terminals. Also, voltage resistance can be enhanced by increasing the distance between terminals. Also, the common terminal can be disposed in the optimal location by matching it to the substrate on which the relay 1 is mounted. Furthermore, the design of the pattern to which the relay 1 is attached can be simplified by reducing the number of terminals.

As discussed above, the contact configuration can be easily changed by just changing the pattern of the base substrate 11, without having to change the configuration of the terminal connectors 14. Furthermore, the number of poles can be set as desired according to the pattern on the base substrate 11, rather than making all of the NC contacts common. Also, not just an NC contact, but also an NO contact or a CO contact can be made common by changing the pattern on the base substrate 11.

The sliders 23 have a shape that curves in the rotational direction of the movable block 5. Therefore, the sliding resistance of the sliders 23 during rotation can be reduced. Also, the sliders 23 have sliders 23 with a shape that curves in a predetermined rotational direction, and sliders 23 with a shape that curves in the opposite direction from said predetermined rotational direction. Therefore, the difference in sliding resistance attributable to a difference in rotational direction can be reduced.

The coil block 6 is divided up into the first coil unit 51 and the second coil unit 52. Therefore, the coil block 6 can be more compact. Also, the magnetic circuit of the first coil unit 51 and the magnetic circuit of the second coil unit 52 are independent of one another. Therefore, it is less likely that there will be interference between the magnetic flux of the first coil 54 and the magnetic flux of the second coil 64. Consequently, magnetic loss is reduced, and a more powerful electromagnetic force can be exerted on the movable block 5.

When the movable block 5 rotates in a predetermined direction, the first contact part 223 comes into contact with the coil block 6, and the amount of rotation of the movable block 5 in the predetermined direction is restricted. When the movable block 5 rotates in the opposite direction from said predetermined direction, the second contact part 224 comes into contact with the coil block 6, and the amount of rotation of the movable block 5 in the opposite direction is restricted. Consequently, the amount of movement of the sliders 23 can be restricted when the continuity state between the sliders 23 and the contactors 13 is switched.

The coil block 6 comes into contact with the protrusions 322, 332, 342, and 352 of the support member 26. Accordingly, the movable block 5 can be stably pressed, with less bias, via the protrusions 322, 332, 342, and 352. Also, when the movable block 5 rotates, there is friction between the coil block 6 and the protrusions 322, 332, 342, and 352 of the support member 26. Therefore, the portion that is worn down by friction between the movable block 5 and the coil block 6 can be limited to the protrusions 322, 332, 342, and 352. Furthermore, the concave parts 323, 333, 343, and 353 are disposed around the protrusions 322, 332, 342, and 352. Therefore, any wear dust produced by friction between the protrusions 322, 332, 342, and 352 and the coil block 6 can be held in the concave parts 323, 333, 343, and 353. This minimizes the amount of wear dust that is scattered into the surrounding area.

An embodiment of the present disclosure was described above, but the present disclosure is not limited to or by the above embodiment, and various modifications are possible without departing from the gist of the disclosure.

The contact configuration in the above embodiment includes NO contacts, NC contacts, and CO contacts, but may instead have only NO contacts, only NC contacts, or only CO contacts, or these contacts may be combined as desired.

Three sliders 23 constituting an NO contact, an NC contact, and a CO contact do not necessarily have to be disposed aligned in the radial direction. Some or all of the three sliders 23 constituting an NO contact, an NC contact, and a CO contact may be disposed at positions that are offset in the peripheral direction from the other sliders 23. Alternatively, some or all of the three sliders 23 constituting an NO contact, an NC contact, and a CO contact may be disposed around a circle whose center is the rotational axis Ra. The same applies to the contactors 13 disposed corresponding to the sliders 23.

The structure of the base block 4 is not limited to the structure in the above embodiment, and may be changed. For example, the base substrate 11 is not limited to being quadrilateral, and may instead have some other shape. The terminals 18 and 19 attached to the terminal connectors 14 of the base substrate 11 do not need to be disposed evenly on the sides of the base substrate 11, and may be disposed wherever desired. In this case, the positions of the terminals 18 and 19 can be easily changed by changing the wiring pattern on the base substrate 11.

The structure of the movable block 5 is not limited to the structure in the above embodiment, and may be changed. For example, the first contact part 223 and the second contact part 224 of the armature may be in contact with not just the first yoke 57 and the second yoke 59, but with some other portion of the coil block 6 instead. The coil block 6 may be supported by some other structure instead of the protrusions of the support member 26. The rotary substrate 21 is not limited to being disk-shaped, and may instead have some other shape.

The structure of the coil block 6 is not limited to the structure in the above embodiment, and may be modified. For instance, an integral coil may be used that is not divided up into the first coil 54 and the second coil 64.

Figure 28:
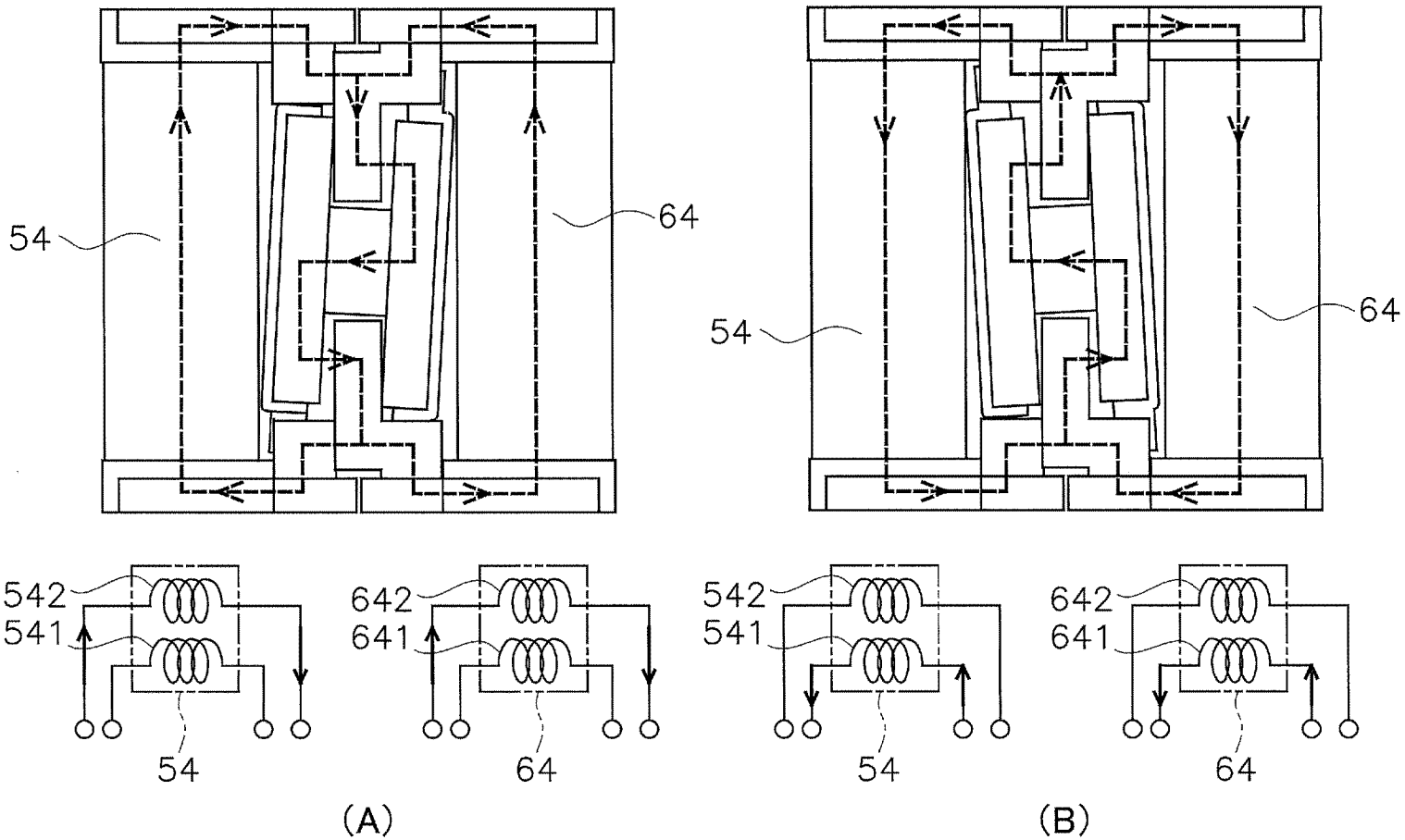
FIG. 28 is a schematic view of the configuration of the coil block pertaining to another embodiment.

As shown in FIG. 28, the first coil 54 may have a first layer 541 and a second layer 542. The second coil 64 may have a first layer 641 and a second layer 642. The second layers 542 and 642 are wound in the opposite direction from that of the first layers 541 and 641. The windings of the first layers 541 and 641 and the windings of the second layers 541 and 641 are connected to independent coil terminals.

As shown in FIG. 28A, for example, the movable block 5 rotates in the opposite direction from the predetermined direction when power is sent to the second layer 542 of the first coil 54 and the second layer 642 of the second coil 64. Also, as shown in FIG. 28B, the movable block rotates in the predetermined direction when power is sent to the first layer 541 of the first coil 54 and the first layer 641 of the second coil 64.

Power does not have to be sent separately to the first coil 54 and the second coil 64, and may instead be sent to both of them at the same time. In this case, a more powerful electromagnetic force can be exerted on the armature 22 by appropriately designing the coil winding direction and the current flow direction.

The parts of which the second coil 64 and the second coil bobbin 63 are composed may be shared with the parts of which the first coil 54 and the first coil bobbin 53 are composed. In this case, the various parts should be disposed in mutually different orientations. Alternatively, the parts of which the second coil 64 and the second coil bobbin 63 are composed may be separate parts with a different coil winding direction with respect to the coil bobbin for the parts of which the first coil 54 and the first coil bobbin 53 are composed.

Figure 29:
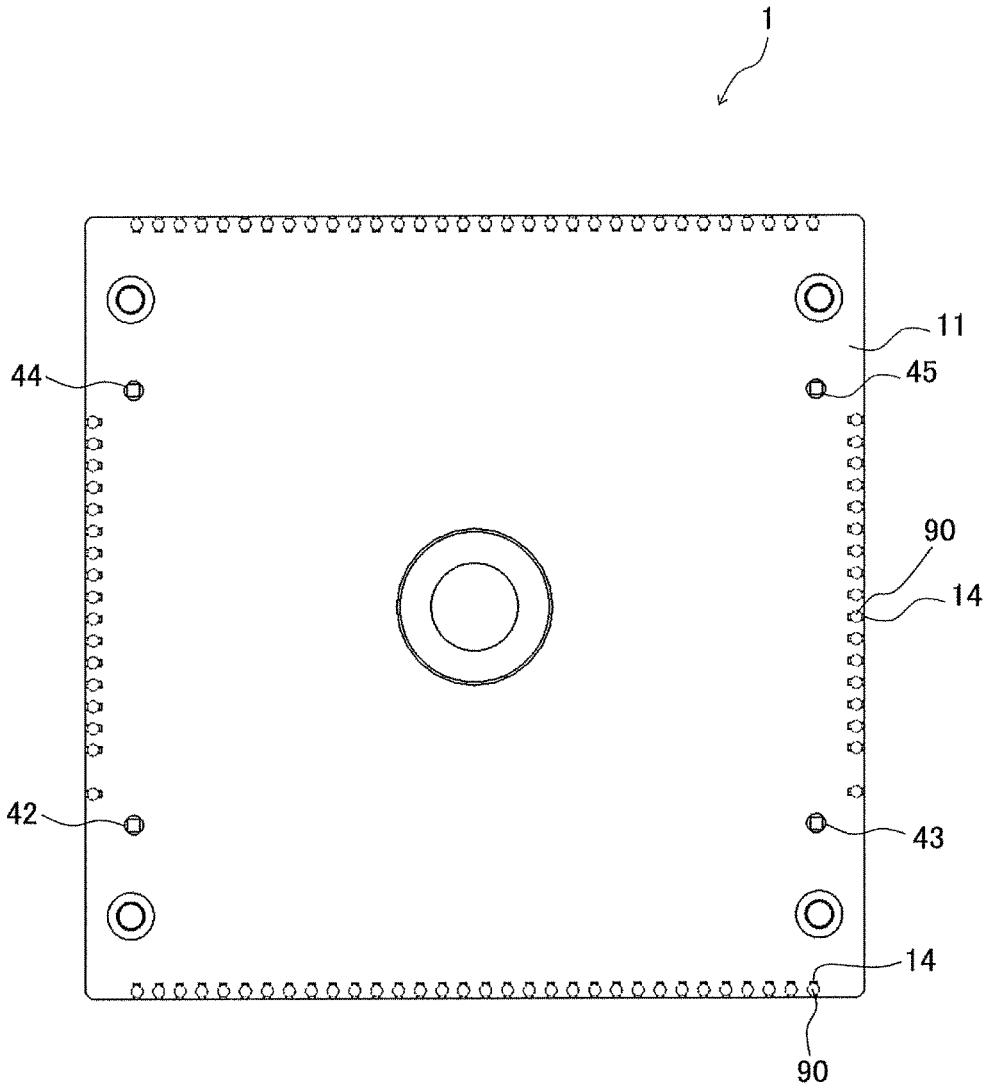
FIG. 29 is a bottom view of the relay pertaining to a first modification example.
Figure 30:
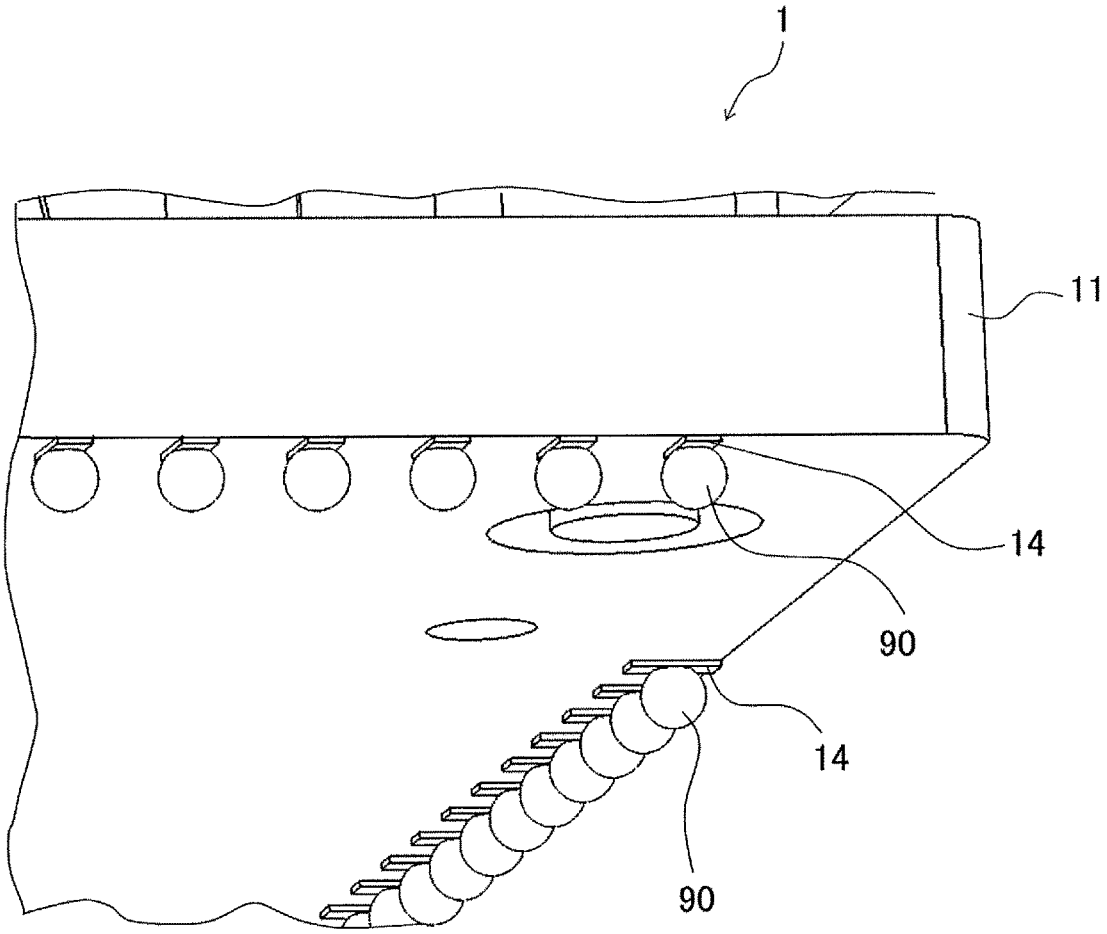
FIG. 30 is a detail view of the relay pertaining to the first modification example.

The terminals connected to the terminal connectors 14 are not limited to being linear terminals that protrude from the base substrate 11 as with the terminals 18 and 19 in the above embodiment, and may be modified. FIG. 29 is a bottom view of the relay 1 pertaining to a first modification example. FIG. 30 is a detail view of the bottom face of the relay 1 pertaining to the first modification example. As shown in FIGS. 29 and 30, with the relay 1 pertaining to the first modification example, the terminals are constituted by a ball grid array (BGA). Specifically, solder balls 90 may be attached to the terminal connectors 14. During mounting of the relay 1, the solder 90 is melted so that the terminal connectors 14 are electrically connected to the substrate.

In this case, since the solder balls 90 are disposed on the terminal connectors 14, there will be less variance in the height and position of the solder 90. Also, since the terminal connectors 14 can be spaced more closely together, more terminal connectors 14 can be provided. Therefore, the terminal configuration pertaining to the first modification example is particularly effective with a base substrate pattern comprising many terminals, as shown in FIG. 26 (discussed above). Furthermore, since the terminals 18 and 19 of the above embodiment can be eliminated, there is also a cost saving.

Figure 31:
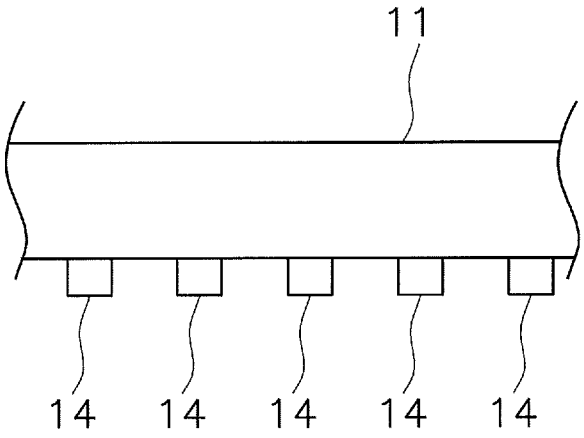
FIG. 31 is a side view of the base substrate pertaining to a second modification example.
Figure 32:
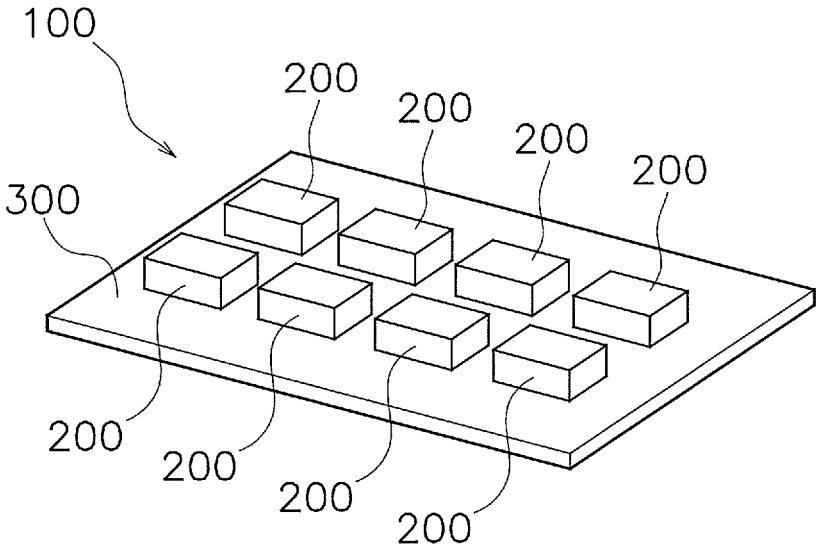
FIG. 32 is an oblique view of a relay module pertaining to related technology.

Alternatively, the terminals may be constituted by a land grid array (LGA), as in the second modification example shown in FIG. 31. Specifically, the plating of the terminal connectors 14 may be made thicker, so that the terminal connectors 14 function directly as terminals. Here again, the same effect can be obtained as with the above-mentioned terminals produced by BGA. Also, there will be even less variance in the height and position of the terminals than with terminals produced by BGA. The contact reliability can also be improved.

INDUSTRIAL APPLICABILITY

The present disclosure provides a relay with which the number of poles of the contacts can be increased while avoiding an increase in size, and the contact reliability of the contacts is high.

REFERENCE SIGNS LIST

5 movable block
11 base substrate
6 coil block
23_1*a* first slider
13_1*a* first contactor
23_1*c* third slider
13_1*c* third contactor
23_1*b* second slider
13_2*b* second contactor
21 rotary substrate
18, 19 terminal
54 first coil
64 second coil
22 armature
223 first contact part
224 second contact part
57 first yoke
59 second yoke
221 first concave part
222 second concave part
26 support member
322, 332, 342, 352 protrusion
323, 333, 343, 353 concave part

The invention claimed is:

1. A relay, comprising:

a movable block provided rotatably around a rotational axis of the movable block, the movable block including a plurality of sliders protruding from a bottom surface of the movable block;

a base substrate including a plurality of contactors configured to come into contact with the sliders, the base substrate disposed opposite the movable block in a rotational axis direction of the movable block, the base substrate being in contact with the sliders, the plurality of contactors on an upper surface of the base substrate, the plurality of sliders and the plurality of contactors facing each other; and a coil block including a coil configured to generate electromagnetic force by electric conduction to rotate the movable block with respect to the base substrate, wherein, as the movable block rotates, continuity is switched between the sliders and the contactors.

2. The relay according to claim 1, wherein the sliders are disposed spaced apart in a radial direction and in a peripheral direction of a rotation of the movable block.

3. The relay according to claim 1, wherein the contactors are disposed spaced apart in the radial direction and in the peripheral direction of the rotation of the movable block on the base substrate.

4. The relay according to claim 1, wherein the sliders include a first slider, the contactors include a first contactor, the first slider is provided movably between a contact position where it is in contact with the first contactor, and a non-contact position where it is not in contact with the first contactor, when the coil block rotates the movable block in a predetermined direction, the first slider moves from the non-contact position to the contact position, and when the coil block rotates the movable block in an opposite direction from the predetermined direction, the first slider moves from the contact position to the non-contact position.

5. The relay according to claim 4, wherein the sliders include a second slider, the contactors include a second contactor, the second slider is provided movably between a contact position where it is in contact with the second contactor, and a non-contact position where it is not in contact with the second contactor, when the coil block rotates the movable block in the predetermined direction, the first slider moves from the non-contact position to the contact position, and the second slider moves from the contact position to the non-contact position, and when the coil block rotates the movable block in the opposite direction from the predetermined direction, the first slider moves from the contact position to the non-contact position, and the second slider moves from the non-contact position to the contact position.

6. The relay according to claim 4, wherein the movable block further includes a third slider, the base substrate further includes a third contactor, and the third slider is in constant contact with the third contactor while the first slider moves between the contact position and the non-contact position.

7. The relay according to claim 6, wherein the third slider is disposed closer to the rotational axis than the first slider.

8. The relay according to claim 1, wherein the movable block further comprises a rotary substrate disposed opposite the base substrate in the rotational axis direction, the sliders are attached to the rotary substrate, and the rotary substrate electrically connects the sliders.

9. The relay according to claim 1, wherein the sliders have a shape that curves toward a rotational direction of the movable block.

10. The relay according to claim 1, wherein the plurality of sliders include sliders with a shape that curves toward the predetermined rotational direction, and sliders with a shape that curves in the opposite direction from the predetermined rotational direction.

11. The relay according to claim 1, further comprising:

a plurality of terminals connected to the base substrate, wherein each of the terminals is electrically connected to one of the contactors on the base substrate.

12. The relay according to claim 11, wherein at least two of the contactors are connected to a common terminal by a pattern on the base substrate.

13. The relay according to claim 1, wherein the coil block includes:

a first coil; and a second coil being separate from the first coil.

14. The relay according to claim 13, wherein a magnetic circuit of the first coil and a magnetic circuit of the second coil are independent of each other.

15. The relay according to claim 13, wherein the first coil and the second coil are disposed spaced apart, and the movable block includes an armature disposed between the first coil and the second coil.

16. The relay according to claim 15, wherein the armature includes a first contact part and a second contact part, when the movable block rotates in a predetermined direction, the first contact part comes into contact with the coil block, thereby restricting an amount of rotation of the movable block in the predetermined direction, and when the movable block rotates in an opposite direction from the predetermined direction, the second contact part comes into contact with the coil block, thereby restricting an amount of rotation of the movable block in the opposite direction.

17. The relay according to claim 16, wherein the coil block includes:

a first yoke protruding toward the armature between the first coil and the second coil; and a second yoke protruding toward the armature from a side opposite the first yoke between the first coil and the second coil, and the armature includes:

a first concave part in which a distal end of the first yoke is disposed; and a second concave part in which a distal end of the second yoke is disposed.

18. The relay according to claim 13, wherein the first coil and the second coil each include a first layer and a second layer whose wiring direction is different from a wiring direction of the first layer.

19. The relay according to claim 1, wherein the movable block is sandwiched between the base substrate and the coil block, and the coil block is attached to the base substrate to press the movable block toward the base substrate.

20. The relay according to claim 19, wherein the movable block includes a plurality of protrusions that come into contact with the coil block.

21. The relay according to claim 20, wherein the protrusions are disposed symmetrically with respect to the rotational axis.

22. The relay according to claim 20, wherein the movable block includes a plurality of concave parts respectively disposed around the protrusions.

23. The relay according to claim 1, wherein the movable block includes an armature including a plurality of armature elements and a magnet; and a support member including a concave part in which the armature is disposed, a first support, a second support, a third support, and a fourth support, one of the plurality of armature elements is disposed between the first support and the second support, and another of the plurality of armature elements is disposed between the third support and the fourth support.

* * * * *